US006856776B2

(12) United States Patent
Matsuda et al.

(10) Patent No.: US 6,856,776 B2
(45) Date of Patent: Feb. 15, 2005

(54) ENDLESS BELT COMPRISING A MEANDERING-PREVENTION MEMBER, AND A PROCESS CARTRIDGE AND AN ELECTROPHOTOGRAPHIC APPARATUS USING SUCH AN ENDLESS BELT

(75) Inventors: Hidekazu Matsuda, Shizuoka (JP); Hiroyuki Kobayashi, Shizuoka (JP); Akihiko Nakazwa, Shizuoka (JP); Atsushi Tanaka, Shizuoka (JP); Tsunenori Ashibe, Kanagawa (JP); Takashi Kusaba, Shizuoka (JP); Ryota Kashiwabara, Shizuoka (JP); Yuji Sakurai, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/372,078

(22) Filed: Feb. 25, 2003

(65) Prior Publication Data

US 2003/0202819 A1 Oct. 30, 2003

(30) Foreign Application Priority Data

Apr. 26, 2002 (JP) ..... 2002-125995
Jul. 12, 2002 (JP) ..... 2002-204293
Sep. 30, 2002 (JP) ..... 2002-285581

(51) Int. Cl.[7] ..... G03G 15/16
(52) U.S. Cl. ..... 399/121
(58) Field of Search ..... 399/121, 303, 399/312, 297, 159, 162–165

(56) References Cited

U.S. PATENT DOCUMENTS 4,873,548 A 10/1989 Kobayashi et al. ..... 355/200
5,331,373 A 7/1994 Nomura et al. ..... 355/200
5,446,525 A 8/1995 Kobayashi et al. ..... 355/210
5,452,056 A 9/1995 Nomura et al. ..... 355/200
5,585,889 A 12/1996 Shishido et al. ..... 355/200
5,585,902 A 12/1996 Nishiuwatoko ..... 355/260
5,713,067 A 1/1998 Mizoe et al. ..... 399/176
5,752,131 A 5/1998 Fujiwara et al. ..... 399/106
5,870,654 A 2/1999 Sato et al. ..... 399/109
5,966,566 A 10/1999 Odagawa et al. ..... 399/109
6,432,324 B1 * 8/2002 Yoshida et al. ..... 252/500
2002/0159789 A1 10/2002 Kusaba et al. ..... 399/111

FOREIGN PATENT DOCUMENTS

JP 9-96943 4/1997
JP 11-272123 * 10/1999

* cited by examiner

*Primary Examiner*—Quana Grainger
(74) *Attorney, Agent, or Firm*—Fitzpatrick, Cella, Harper & Scinto

(57) ABSTRACT

An electrophotographic endless belt has a belt-like substrate, and a meandering-preventive member for preventing the electrophotographic endless belt from meandering and a position detection member for detecting a prescribed position of the electrophotographic endless belt. The meandering preventive member is, disposed on the inner-periphery side of one end portion of the belt-like substrate, and the position detection member is disposed on the outer-periphery side of the other end portion of the belt-like substrate. The meandering-preventive member and the position detection member are kept apart by a distance of from 200 mm to 250 mm in the width direction of the electrophotographic endless belt. A process cartridge and an electrophotographic apparatus employ such an electrophotographic endless belt as an intermediate transfer belt.

38 Claims, 7 Drawing Sheets

ENDLESS BELT COMPRISING A MEANDERING-PREVENTION MEMBER, AND A PROCESS CARTRIDGE AND AN ELECTROPHOTOGRAPHIC APPARATUS USING SUCH AN ENDLESS BELT

BACKGROUND OF THE INVENTION

1. Field of the Invention

This invention relates to an electrophotographic endless belt, and in particular, an intermediate transfer belt, and also relates to a process cartridge and an electrophotographic apparatus which have the intermediate transfer belt and an electrophotographic photosensitive member.

2. Related Background Art

Besides rigid-body drum-shaped members, flexible endless-belt-shaped members (electrophotographic endless belts) are conventionally used in intermediate transfer belts, electrophotographic photosensitive members, transfer-transport members, fixing members and so forth used in electrophotographic apparatus such as copying machines and laser beam printers.

Usually, in an electrophotographic apparatus, an electrophotographic endless belt is put over, and supported on, at least two rollers disposed on its inner-periphery side and is rotatably driven under the application of any desired tension when used.

However, because of any slight errors or scattering in the diameter, the deflection, the rotating-shaft straightness and the roller-to-roller parallelism of the rollers supporting the electrophotographic endless belt, it is inevitable for the electrophotographic endless belt to meander from side to side during its rotating drive.

Such meandering of the electrophotographic endless belt from side to side makes the exposure position and the transfer position deviate, to cause image misregistration. Also, in the case of a full-color electrophotographic apparatus, it makes the position of image formation deviate for each color to cause color misregistration (or color shift) when color toner images are superimposed on the electrophotographic endless belt or on a transfer material transported on the electrophotographic endless belt.

Accordingly, in order to prevent the electrophotographic endless belt from meandering, various methods have ever been proposed. In these recent years, methods in which a meandering-preventive member is provided on the inner periphery of a belt-like substrate of the electrophotographic endless belt to prevent the electrophotographic endless belt from meandering are proposed in a large number.

For example, a method is available in which a roller, provided over the whole outer periphery thereof with a groove that may fit in the cross-sectional shape of such a meandering-preventive member, is used and an electrophotographic endless belt, provided with the meandering-preventive member over the whole inner periphery, is rotated, making the meandering-preventive member fit in this groove of the roller to prevent the belt from meandering.

As another example, a method is available in which a roller, having substantially the same length as the distance between inner sides of meandering-preventive members provided on both ends of a belt-like substrate of an electrophotographic endless belt, is used and the belt is put over this roller and is rotated, making its both-end meandering-preventive members and the roller fit in each other to prevent the belt from meandering.

As still another example, a method is available in which a roller, provided on one end in the axial direction thereof with a terraced portion in which a meandering-preventive member of an electrophotographic endless belt fits, is used to prevent the electrophotographic endless belt from meandering.

The above methods can make the electrophotographic endless belt travel smoothly without bringing it into meandering. This enables formation of good images free of any image misregistration or color misregistration.

Meanwhile, usually, where the electrophotographic endless belt is used in an electrophotographic apparatus, it has some means for controlling the position at which a toner image begins to be written.

For example, Japanese Patent Application Laid-Open No. 9-96943 and so forth disclose a method in which a mark (a position detection member) is provided on a beltlike substrate of an electrophotographic endless belt and the writing of an image is started upon detection of this mark. This method is preferable because the detection can be made very inexpensively and also the apparatus can be made compact.

Now, usually, electrophotographic endless belts mostly have a small layer thickness from the viewpoint of making the electrophotographic apparatus compact and light-weight, and are also required to have a flexibility to a certain extent because they are used in the state that the belt is put over rollers having a small diameter.

On the other hand, the meandering-preventive member fitted to a belt-like substrate of the electrophotographic endless belt is required to have a rigidity high enough to be durable to the draw force of the electrophotographic endless belt.

Where the belt-like substrate of such a thin-film and flexible electrophotographic endless belt is provided with the meandering-preventive member having a rigidity, a slight difference is produced in the degree of flexing of the electrophotographic endless belt when the electrophotographic endless belt is put over the rollers, because there is a difference in stiffness (nerve or rigidity) between the part provided with the meandering-preventive member and the part not provided with it.

In the case when the meandering-preventive member is provided on the inner periphery of the belt-like substrate of the electrophotographic endless belt and the position detection member is provided on the outer periphery of that part, it has occurred in conventional cases that, as shown in FIG. 8, a meandering-preventive member 82 fitted in a groove 86 of a roller 87 rises because of this slight difference in flexing properties and consequently a belt-like substrate 81 of an electrophotographic endless belt and a position detection member 83 also rise to make any accurate detection impossible to cause image misregistration (reference numeral 84 denotes a light-projecting part of a position detection sensor, and 85 denotes a light-receiving part of the position detection sensor).

It is also the case of the meandering-preventive member that, usually, a member cut beforehand to a length adjusted to the inner-peripheral length of the belt-like substrate is attached to the inner periphery of the belt-like substrate. In such a case, it is unavoidable for the meandering-preventive member to have a joint. In particular, where the position detection member is present on the joint, it is impossible to make any accurate position detection because of the extreme difference in flexing properties. In order to avoid this, the joint of the meandering-preventive member may be avoided when the position detection member is fitted, or the position of the position detection member may be avoided when the meandering-preventive member is fitted. However, taking account of a mass production process, the addition of a step of judging and avoiding the joint of the meandering-preventive member or the position of the position detection member causes a lowering of productivity or an increase in management, resulting in a raise in cost.

Accordingly, as a means for preventing the meandering-preventive member from rising, a method is available in which the tension (belt tension) applied when the electrophotographic endless belt is put over is made higher. There, however, is a possibility that making the tension higher causes a creep of the electrophotographic endless belt to shorten its life. Also, too a high belt tension may bring about a possibility of promoting the meandering of the electrophotographic endless belt.

Conventionally, in order to solve such problems, it has been necessary to use a meandering-preventive member having a relatively low rigidity. However, the use of such a meandering-preventive member having a low rigidity may weaken the effect of preventing the belt from meandering in the width direction. In a bad case, it has even occurred that the meandering-preventive member runs on the roller.

In particular, where a process cartridge, in which an electrophotographic photosensitive member and an intermediate transfer belt are integrally supported, is used differently from a case in which it is actually installed and used in the main body of an electrophotographic apparatus, it may often undergo many vibrations or be placed in a high-temperature and high-humidity environment for a long time during distribution in the market. When it is placed in such a severe environment for a long time, the progress of the creep of the belt is accelerated, and moreover the belt may come to have the habit of bending (or permanent bending) as a result of compression set. When the position detection member is present here, a problem may arise that any accurate position detection can not be made. For such reasons, the above problems may more remarkably arise when the process cartridge, in which an electrophotographic photosensitive member and an intermediate transfer belt are integrally supported, is used.

SUMMARY OF THE INVENTION

An object of the present invention is to provide an electrophotographic endless belt which enables the formation of good images free of any image misregistration or color misregistration, without causing problems arising from making the belt tension higher and making use of a low-rigidity meandering-preventive member.

Another object of the present invention is to provide a process cartridge and an electrophotographic apparatus which have employed the above electrophotographic endless belt as an intermediate transfer belt.

The present invention provides an electrophotographic endless belt having a belt-like substrate, a meandering-preventive member and a position detection member, wherein:

- the meandering-preventive member is disposed on the inner peripheral side of one end portion of the belt-like substrate;
- the position detection member is disposed on the outer peripheral side of the other end portion of the belt-like substrate; and
- the meandering-preventive member and the position detection member are kept apart by a distance of from 200 mm to 250 mm in the width direction of the electrophotographic endless belt.

The present invention also provides a process cartridge and an electrophotographic apparatus which have employed the above electrophotographic endless belt as an intermediate transfer belt.

BRIEF DESCRIPTION OF THE INVENTION

Figure 6:
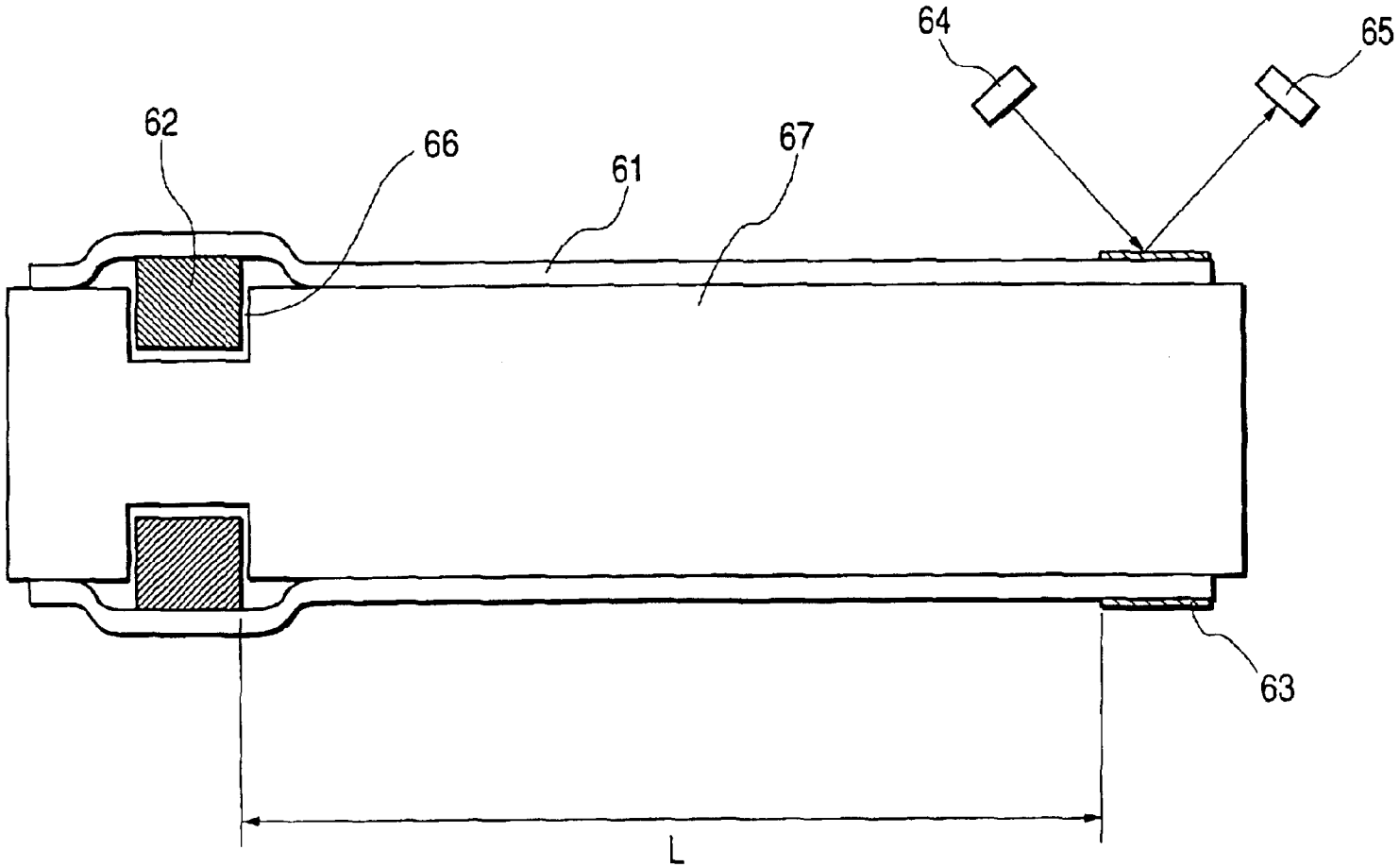

FIG. 6 is a view showing the relationship between the electrophotographic endless belt and the position detection sensor in the present invention and a case in which a roller, provided over the whole outer periphery thereof with a groove that may fit in the cross-sectional shape of the meandering-preventive member, is used and an electrophotographic endless belt provided with the meandering-preventive member over the whole inner periphery is rotated, while making the meandering-preventive member fit in this groove of the roller to prevent the belt from meandering.

Figure 7:
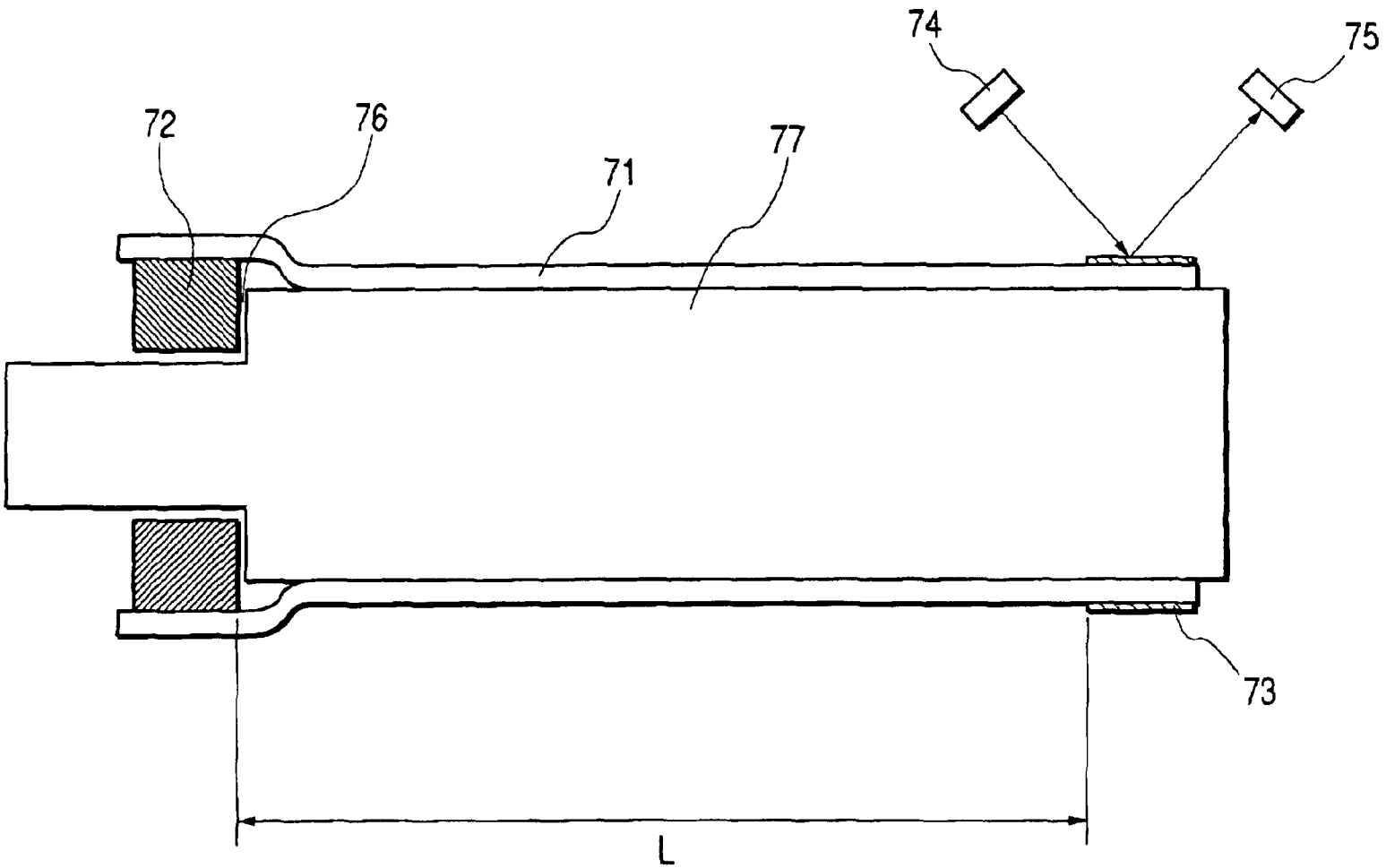

FIG. 7 is a view showing the relationship between the electrophotographic endless belt and the position detection sensor in the present invention and a case in which a roller, provided on one end in the axial direction thereof with a terraced portion in which the meandering-preventive member fits, is used to prevent the electrophotographic endless belt from meandering.

Figure 8:
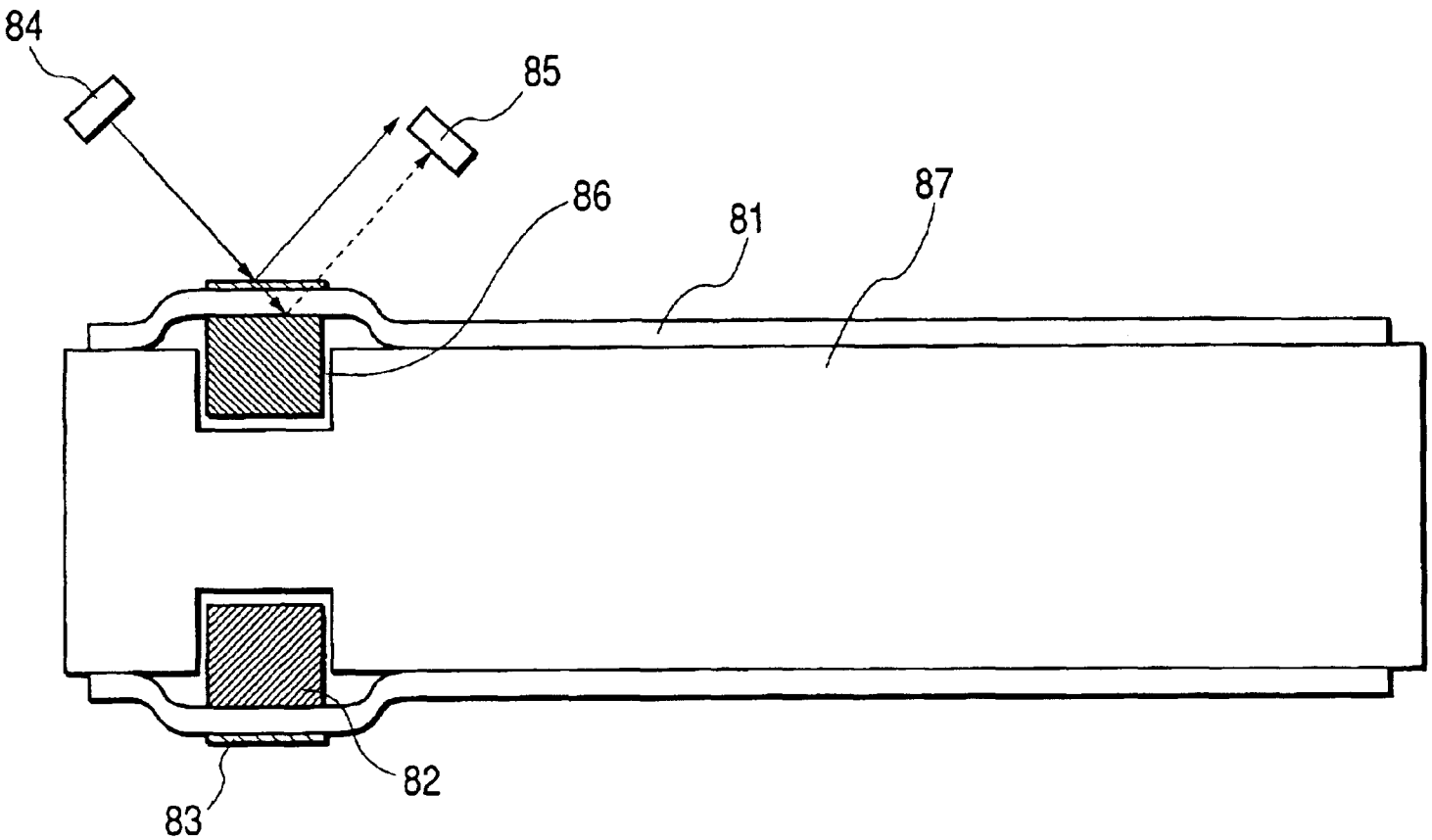

FIG. 8 is a view showing an electrophotographic endless belt and a position detection sensor in a conventional case.

DESCRIPTION OF THE PREFERRED EMBODIMENTS

The present invention is described below in detail.

The electrophotographic endless belt of the present invention has a belt-like substrate, a meandering-preventive member and a position detection member. Then, in order to prevent any position detection difference due to a rise at the belt-like substrate surface of the meandering-preventive member, caused by differences in the thickness, the physical properties and the flexing properties between the belt-like substrate and the meandering-preventive member, as shown in FIG. 6, a meandering-preventive member 62 for preventing the electrophotographic endless belt from meandering is disposed on the inner-periphery side of one end portion of a belt-like substrate 61, and a position detection member 63 for detecting a preset position of the electrophotographic endless belt is disposed on the outer peripheral side of the other end portion of the belt-like substrate 61. Then, the meandering-preventive member 62 and the position detection member 63 are set apart by a distance of from 200 mm to 250 mm. Reference numeral 64 denotes a light-projecting part of a position detection sensor, and 65 denotes a light-receiving part of the position detection sensor. Also, reference numeral 66 denotes a groove in which the meandering-preventive member 62 is fitted.

Shown in FIG. 6 is an embodiment in which a roller 67, provided over the whole outer periphery thereof with the groove 66 that may fit in the cross-sectional shape of the meandering-preventive member 62, is used and the electrophotographic endless belt, provided with the meandering-preventive member 62 over the whole inner periphery, is rotated, making the meandering-preventive member 62 fit in this groove 66 of the roller 67 to prevent the belt from meandering. Instead, as shown in FIG. 7, an embodiment may be employed in which a roller 77, provided on one end in the axial direction thereof with a terraced portion 76 in which the meandering-preventive member fits, is used to prevent the electrophotographic endless belt from meandering. In FIG. 7, reference numeral 71 denotes a belt-like substrate; 72 denotes a meandering-preventive member, 73 denotes a position detection member; 74 denotes a light-projecting part of a position detection sensor, 75 denotes a light-receiving part of the position detection sensor; 76 denotes the terraced portion; and 77 denotes the roller over which the electrophotographic endless belt is put.

In FIGS. 6 and 7, letter symbol L denotes the distance between the meandering-preventive member and the position detection member.

If as shown in FIG. 8 the position detection member is fitted to an end on the same side as the end where the meandering-preventive member has been disposed, the position detection member is affected by a rise of the meandering-preventive member to make any accurate detection impossible, resulting in a lowering of the precision of position detection made by the position detection sensor and the position detection member.

The electrophotographic endless belt (belt-like substrate) may also usually have a width ranging from 200 mm to 400 mm. If it has a width of less than 200 mm, the adaptable paper size becomes too limited (to be adaptable to, e.g., A4 size). If it has a width of more than 400 nm, it makes the electrophotographic apparatus large. Further taking account of the goals of both making the electrophotographic apparatus compact and adapting the device to different paper sizes, the electrophotographic endless belt (belt-like substrate) may preferably have a width ranging from 220 mm to 350 mm.

Accordingly, it is preferable for the meandering-preventive member and position detection member to be set apart in the distance of from 200 mm to 250 mm by the width direction of the electrophotographic endless belt. If their distance is less than 200 mm, not only may the position detection precision be lower, but also there is a possibility that they come into the image formation region. If on the other hand, it is more than 250 mm, the electrophotographic endless belt becomes large, consequently making the electrophotographic apparatus large.

It is more preferable for the meandering-preventive member and position detection member to be set apart by a distance of from 220 mm to 250 mm.

Setting apart the meandering-preventive member and the position detection member makes it unnecessary to detect the joint of the meandering-preventive member so as to avoid it, and may cause neither a lowering of productivity, nor a rise in cost.

Setting apart the meandering-preventive member and the position detection member can also prevent making the belt tension higher than is necessary, and makes it possible for the electrophotographic endless belt to be put over the roller at an appropriate tension. Hence, its creep can be kept from occurring, leading to lengthening of the life of the belt. In the present invention, the belt tension may preferably range from 5 N to 70 N.

Setting apart the meandering-preventive member and the position detection member still also makes it possible to use a meandering-preventive member with a high modulus of elasticity, having a higher meandering-preventive effect, which has not been used because of its high rigidity, so that the color misregistration or the like can be made to occur vastly less often. In the present invention, the meandering-preventive member may preferably have a modulus of elasticity ranging from 0.01 Pa to 100 MPa, and more preferably from 0.1 Pa to 50 MPa.

The meandering-preventive member and the position detection member may also preferably be disposed at a place outside the range in which the toner for forming a desired image is to be laid (image formation region) (i.e., disposed at a non-image formation region), and within the range that they do not make the electrophotographic apparatus large. If the meandering-preventive member and the position detection member are disposed in the image formation region, images may adversely be affected by a rise of the meandering-preventive member or a bump of the electrophotographic endless belt, which is ascribable to the thickness of the position detection member.

The position detection member may also preferably be provided in plurality on the belt-like substrate of the electrophotographic endless belt. If the position detection member is present only at one spot in the peripheral direction of the electrophotographic endless belt, it inevitably takes a long time for the belt to rotate until the position detection member is detected after the switch has been turned on, and there is a possibility of causing a lowering of throughput.

In order to obtain good full-color images, it is necessary as a matter of course to prevent color misregistration by performing accurate position detection. It is also important to assure proper image density. For that reason, a patch is commonly formed on the belt-like substrate of the electrophotographic endless belt to perform density control on the basis of the patch. Here, a belt-like substrate whose surface has a high spectral reflectance is preferable because stable and accurate density detection can be performed. If the surface of the belt-like substrate has a low spectral reflectance, not only may any accurate position detection not be performed, but also any proper image density may not be achieved.

Figure 3:
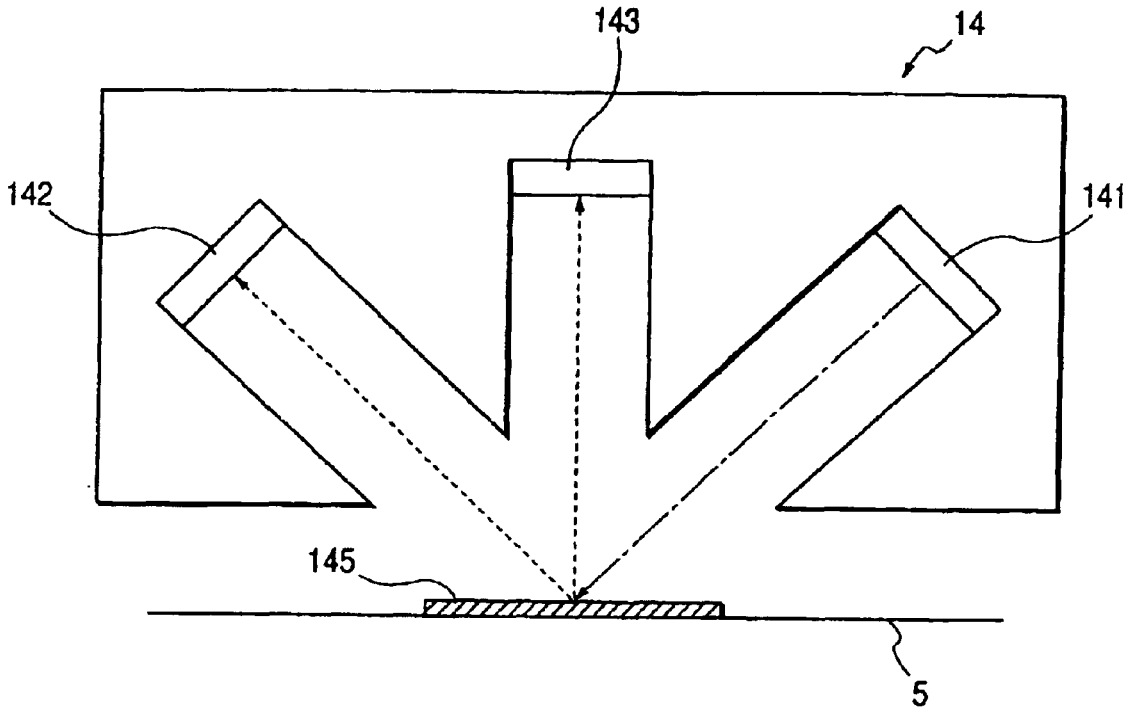
FIG. 3 is a schematic view showing an example of the construction of a density detection sensor.

FIG. 3 is a schematic view showing an example of the construction of a density detection sensor for performing density detection when the density is controlled on the basis of the patch.

As an optical means for detecting patch density, an optical sensor is used in which a patch 145 is irradiated by light emitted from a light-emitting device 141 such as an LED and the amount of reflected light of that light that has depended on the patch density can be detected by specular reflected light and diffused light by means of two light-receiving devices 142 and 143 such as photodiodes.

As the spectral reflectance of the surface of the position detection member, it is preferable to use what is different from the spectral reflectance of the surface of the belt-like substrate of the electrophotographic endless belt. In particular, the spectral reflectance of the position detection member may preferably be made lower than the spectral reflectance of the belt-like substrate surface because there is a tendency that it is preferable for the surface of the belt-like substrate of the electrophotographic endless belt to have a higher spectral reflectance. If the belt-like substrate and the position detection member have the same spectral reflectance, the position detection sensor may perform detection with difficulty to bring about a possibility of damaging its original performance. Stated specifically, the spectral reflectance of the position detection member surface and the spectral reflectance of the belt-like substrate surface may have a difference of 5 or more. This is preferable because a high sensor output can be obtained and accurate position detection can be performed without any misdetection. If the difference between the spectral reflectance of the position detection member surface and the spectral reflectance of the belt-like substrate surface is less than 5, accurate position detection may be performed with difficulty.

As a method of making the belt-like substrate surface have a high spectral reflectance, it is preferable to incorporate a colorant in the belt-like substrate to form it as a colored layer, or provide a colored layer as a part of the belt-like substrate on its outside.

The colored layer may preferably have a layer thickness of from 40 $\mu$m to 200 $\mu$m, and more preferably from 50 $\mu$m to 150 $\mu$m. If it has a layer thickness of less than 40 $\mu$m, the incident light may be transmitted through the colored layer to make it difficult to achieve a sufficient reflected-light intensity of the light reflecting from the belt-like substrate surface. If, on the other hand, the colored layer has a layer thickness of more than 200 $\mu$m, the whole electrophotographic endless belt (belt-like substrate) may have so large a layer thickness that the belt may come to have a habit of bending at its part that is put over the rollers, and any accurate reflected light can not be obtained at this part to cause faulty images.

Materials usable as the colorant may include, e.g., white pigments such as titanium oxide, zinc oxide, barium sulfate and silica, blue pigments such as phthalocyanine, red pigments such as dimethylquinacridone, and yellow pigments such as disazo yellow. Of these, white pigments are preferred in view of reflectance and cost. Of the white pigments, zinc oxide and titanium oxide are preferred in view of reflectance, cost and dispersion stability.

The belt-like substrate of the electrophotographic endless belt of the present invention may also preferably have a glossiness of 35 or more. If it has a glossiness of less than 35, it may be difficult to perform accurate density detection when the density is detected. Also, if it has a low glossiness, any good contrast may become unobtainable for both black toner and color toner.

The belt-like substrate of the electrophotographic endless belt of the present invention may include those composed chiefly of thermoplastic resin, thermosetting resin or rubber. Those composed chiefly of thermoplastic resin are preferred.

As the thermoplastic resin, it may include, e.g., olefin resins such as polyethylene and polypropylene, polystyrene resins, acrylic resins, ABS resins, polyester resins (such as PET, PBT, PEN and PAR), polycarbonate resins, sulfur-containing resins such as polysulfone, polyether sulfone and polyphenylene sulfide, fluorine-containing resins such as polyvinylidene fluoride and a polyethylene-tetrafluoroethylene copolymer, polyurethane resins, silicone resins, ketone resins, polyvinylidene chloride, thermoplastic polyimide resins, polyamide resins, modified polyphenylene oxide resins, and various modified resins or copolymers of these, any one or more kinds of which may be used.

When the electrophotographic endless belt is used in the electrophotographic apparatus, it is also necessary to regulate its electrical resistance value adapted to its electrophotographic process.

There are no particular limitations on the additives mixed in order to regulate the electrical resistance value of the intermediate transfer belt (belt-like substrate) of the present invention. As a conductive filler for regulating the resistance, it may include carbon black and various conductive metal oxides. As a non-filler type resistance regulator, it may include low-molecular weight ion conducting materials such as various metal salts and glycols, antistatic resins containing an ether linkage or a hydroxyl group in the molecule, and organic high polymers showing electroconductivity.

There are also no particular limitations on processes for obtaining the belt-like substrate of the electrophotographic endless belt of the present invention. As its forming process, a process for producing a seamless belt may be employed, and a production process having so high a production efficiency as to enable cost saving is preferred. As a method therefor, a method is available in which an extrusion material is continuously melt-extruded from a circular die and thereafter the product thus extruded is cut in any necessary length to produce a belt. For example, blown-film extrusion (inflation) is preferable.

An example of a method of producing the belt-like substrate of the electrophotographic endless belt used in the present invention is described below.

Figure 4:
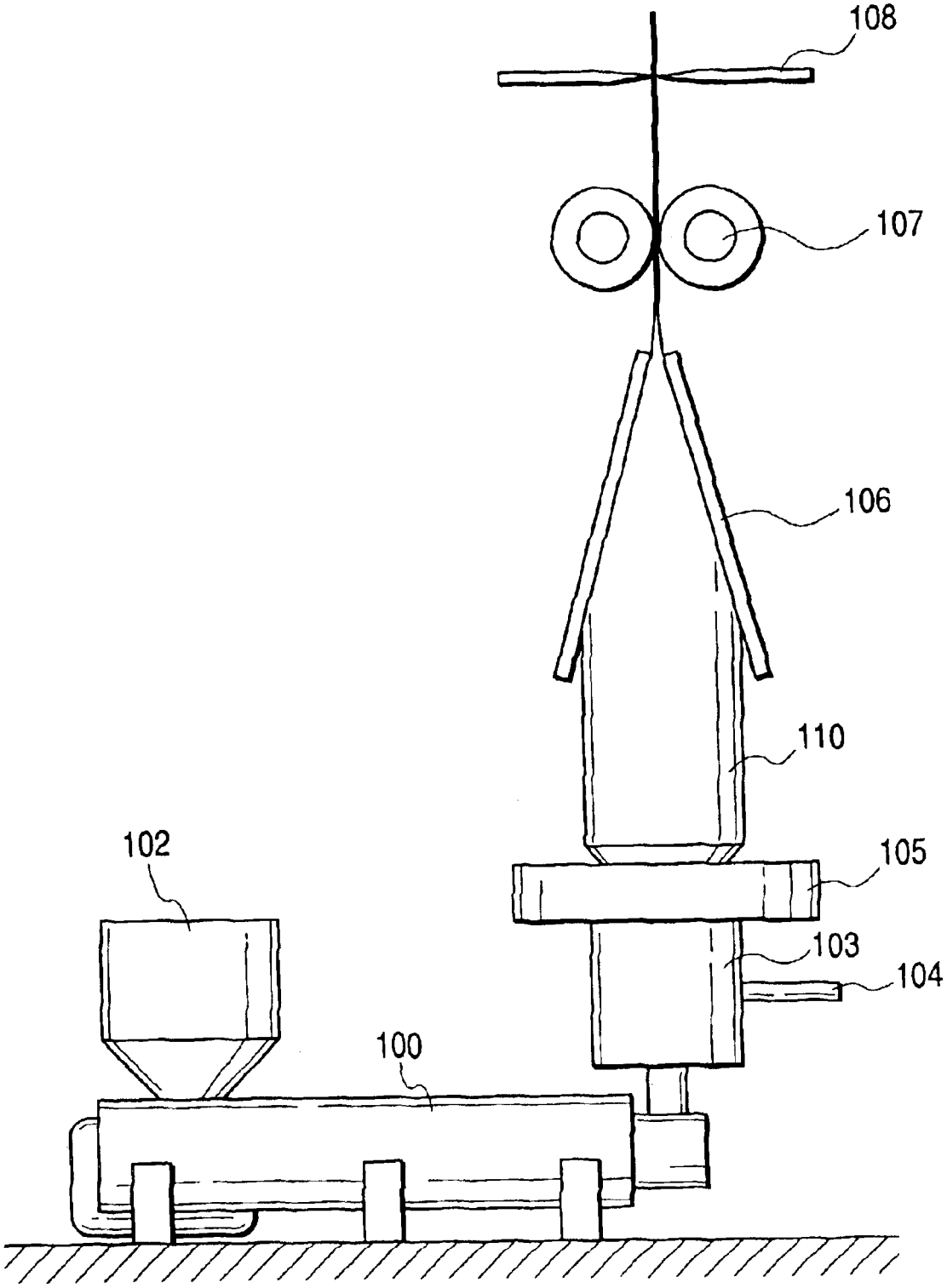
FIG. 4 is a schematic view showing an example of the construction of an extrusion apparatus for forming an intermediate transfer belt (single layer) of the present invention.

FIG. 4 schematically shows an example of the construction of an extrusion apparatus (blown-film extrusion or inflation apparatus) for forming the belt-like substrate of the electrophotographic endless belt of the present invention. This apparatus consists chiefly of an extruder, an extruder die and a gas blowing unit.

First, materials such as an extrusion resin (which may also be a rubber), a conducting agent and additives are premixed under the desired formulation and thereafter kneaded and dispersed to prepare an extrusion material, which is then put into a hopper 102 installed to an extruder 100.

The extruder 100 has a preset temperature and extruder screw construction which have been so selected that the extrusion material may have a melt viscosity necessary for enabling extrusion into a belt in the post step and also the materials can be dispersed uniformly with one another.

The extrusion material is melt-kneaded in the extruder 100 into a melt, which then enters a circular die 103. The circular die 103 is provided with a gas inlet passage 104. Through the gas inlet passage 104, gas (air) is blown into the center of the circular die 103, whereupon the melt having passed through the circular die 103 inflates while scaling up in the diametrical direction to come into a tubular film 110.

The gas to be blown here may be air, and besides may be selected from nitrogen, carbon dioxide and argon.

The extruded product having thus inflated (tubular film) is drawn upward while being cooled by an outside-cooling ring 105. Usually, in such a blown-film extrusion apparatus, a method is employed in which the tubular film 110 is pressed forcibly from the right and the left by means of stabilizing plates 106 to fold it into a sheet, and then is drawn off at a constant speed while being so sandwiched with pinch rollers 107 that the air in the interior does not escape.

Then, the tubular film thus drawn off is cut with a cutter 108 to obtain a tubular film with the desired size.

Next, this tubular film is worked using a form (for shaping) in order to regulate its surface smoothness and size and to remove any folds made in the film at the time of draw-off.

Stated specifically, a method is usable which makes use of a set of cylindrical forms made of materials having different coefficients of thermal expansion and having different diameters.

A small-diameter cylindrical form (inner form) has a coefficient of thermal expansion made larger than the coefficient of thermal expansion of a large-diameter cylindrical form (outer form). The tubular film obtained by extrusion is placed over this inner form. Thereafter, the inner form with film is inserted into the outer form so that the tubular film is held between the inner form and the outer form. A gap between the inner form and the outer form may be determined by calculation on the bases of heating temperature, difference in coefficient of thermal expansion between the inner form and the outer form, and pressure required.

A form in which the inner form, the tubular film and the outer form have been set in this order from the inside is heated to the vicinity of the softening point temperature of the resin used. As a result of the heating, the inner form, having a larger coefficient of thermal expansion, expands more than the inner diameter of the outer form and hence a uniform pressure is applied to the whole tubular film. Here, the surface of the tubular resin film having reached the vicinity of its softening point is pressed against the inner surface of the outer form having been worked smoothly, so that the smoothness of the surface of the tubular film is improved. Thereafter, these are cooled and the tubular film is removed from the forms, so that smooth surface characteristics can be attained.

It is more preferable to use the above method as a method of obtaining (the belt-like substrate of) an electrophotographic endless belt having a small right-and-left difference in inner-peripheral length in order to prevent the belt from meandering.

Figure 5:
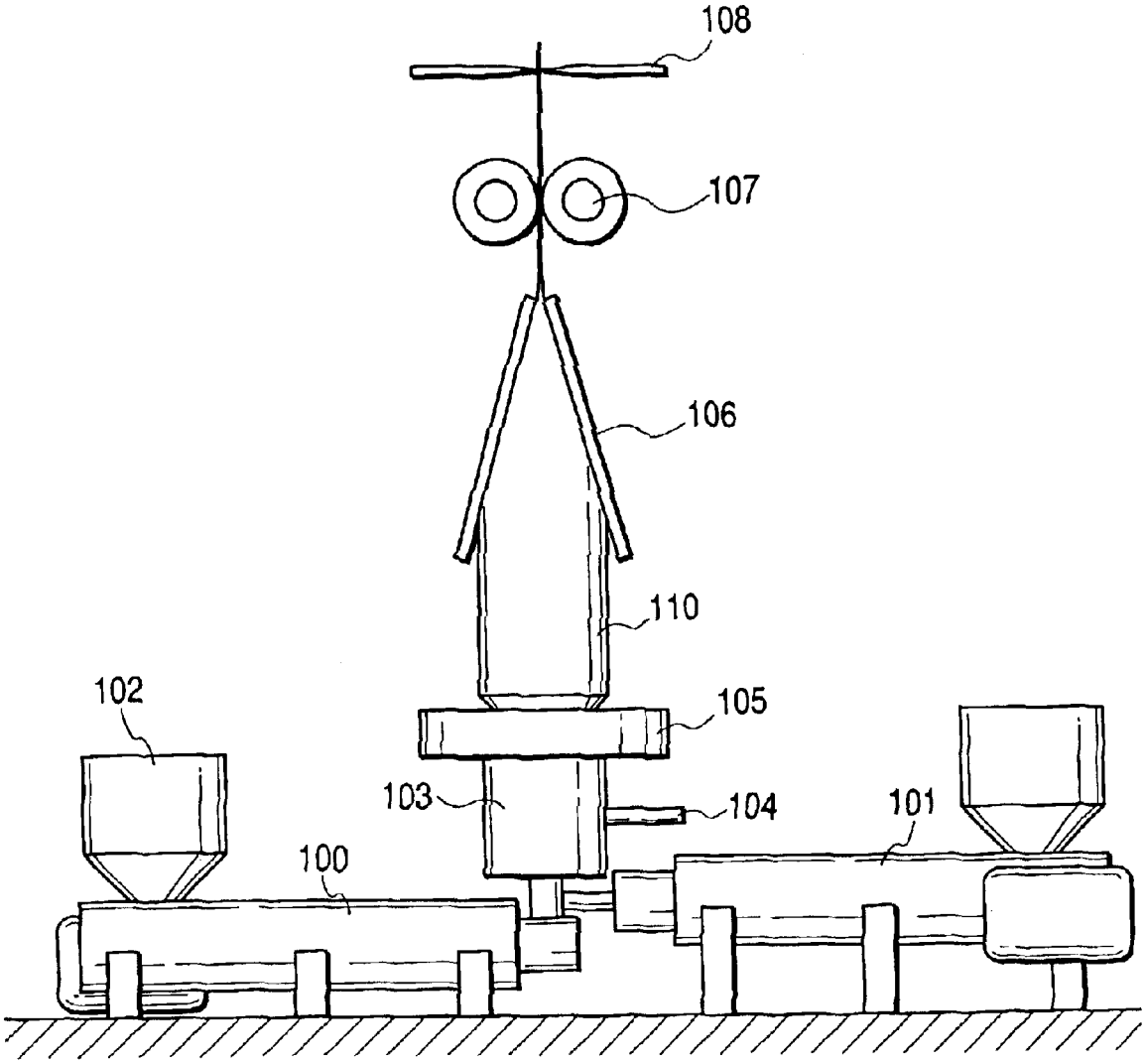
FIG. 5 is a schematic view showing an example of the construction of an extrusion apparatus for forming an intermediate transfer belt (double layer) of the present invention.

The foregoing description relates to a single-layer belt. In the case of the endless belt of double-layer construction, an extruder 101 is additionally provided as shown in FIG. 5. Simultaneously with the kneaded melt held in the extruder 100, a kneaded melt in the extruder 101 is sent to a double-layer circular die 103, and the two layers are scale-up inflated simultaneously, thus obtaining a double-layer belt.

In the case of a triple- or more layer construction, the extruder may of course be provided in the number corresponding to the number of layers. Thus, the present invention makes it possible to extrude not only electrophotographic endless belts (belt-like substrates) of a single-layer construction but also those of a multi-layer construction, with good dimensional precision through one step and also in a short time. The fact that the extrusion can be made in a short time means that mass production and low-cost production can be made.

With regard to the ratio of the thickness of the extruded tubular film to the width of a gap (die slit) of the circular die, the ratio of the former to the latter may preferably be not more than ⅓, and particularly preferably not more than ⅕.

With regard to the ratio of the outer diameter of the tubular film to the outer diameter of the gap (die slit) of the circular die, it may preferably be in the range of from 50% to 400%.

These values represent the state of stretch of the material. If the thickness ratio is more than ⅓, the film may insufficiently stretch to tend to cause difficulties such as low strength, uneven resistance and uneven thickness. As for the ratio of the outer diameter of the tubular film to the outer diameter of the gap (die slit) of the circular die, if it is more than 400% or less than 50%, the film has stretched in excess, resulting in a low extrusion stability or making it difficult to ensure the thickness necessary for the present invention.

In order to achieve preferable spectral reflectance, it is necessary to appropriately control the types and mixing amounts of the extrusion resin (rubber), the conductive agent and additives and the state of dispersion of these components. If the conductive agent and additives stand agglomerated or some components stand extremely separate, it is difficult to achieve appropriate spectral reflectance.

Now, the meandering-preventive member of the electrophotographic endless belt according to the present invention may preferably have a thickness of from 0.3 mm to 6 mm. If it has a thickness of less than 0.3 mm, any sufficient meandering-preventive effect may not be obtained and, in some cases, the meandering-preventive member may even run on the roller. If, on the other hand, it has a thickness of more than 6 mm, the difference between the inner peripheral length of the belt-like substrate of the electrophotographic endless belt and the inner peripheral length of the meandering-preventive member may become so large that, in the actual use of the electrophotographic endless belt, the meandering-preventive member may greatly rise without following up any bend of the electrophotographic endless belt when the electrophotographic endless belt travels over the part where it winds around the roller over which it is put.

To attach the meandering-preventive member to the belt-like substrate, the former may preferably be attached to the latter with a pressure-sensitive adhesive, double-coated tape as being inexpensive, enabling attachment with good precision and being capable of maintaining adherence over a long period of time. Incidentally, the pressure-sensitive adhesive, double-coated tape may more preferably be one having a reinforcing base material (support) for its adhesive, in view of working precision, attachment precision, adherence, durability and so forth.

As to materials and characteristics of the reinforcing base material, there are no particular limitations thereon as long as it can maintain the attachment precision. It may include, e.g., sheets of paper such as kraft paper, Japanese paper and crepe paper, single or mixed woven fabrics of rayon (staple fiber), cotton, acetate, glass, polyester and the like Vinylon; fabrics of polyethylene, polypropylene and the like; nonwoven fabrics of rayon, polypropylene, aromatic polyamide, polyester glass and the like; cellophane; films of acetate, polyvinyl chloride, polyethylene, polypropylene and the like; single or mixed rubber sheets of polyurethane rubber, natural rubber, styrene-butadiene rubber, butyl rubber, polychloroprene rubber and the like; and foams of polyurethane, polyethylene, butyl rubber, polychloroprene rubber, acrylic rubber and the like.

Of these, materials which may particularly preferably be used include nonwoven fabrics of rayon, polypropylene, aromatic polyamide, polyester, glass and the like. These have good workability, promise superior working precision and attachment precision, are available at a low price and have the effect of improving adhesive (pressure sensitive) strength greatly. The reinforcing base material of the pressure-sensitive adhesive, double-coated tape may preferably have a thickness of from 25 $\mu$m to 500 $\mu$m.

As a pressure-sensitive adhesive (bonding material) of the pressure-sensitive adhesive, double-coated tape, it may include rubber types such as urethane rubber, natural rubbers, styrene-butadiene rubbers, isobutylene rubbers, isoprene rubbers, a styrene-isoprene block copolymer and a styrene-butadiene block copolymer, acrylic types; and silicone types. Also, any of these materials, or any of these and other material, may be used in a combination of two or more. Of these, a pressure-sensitive adhesive, double-coated tape making use of an acrylic pressure-sensitive adhesive is preferred as having superior adhesive strength.

As a material of the meandering-preventive member, any material may be used as long as they have a strength high enough to prevent the electrophotographic endless belt from meandering. For example, it may include solids or foams of isoprene rubber, styrene-butadiene rubber, butadiene rubber, ethylene-propylene rubber, chloroprene rubber, nitrite rubber, polyurethane rubber, epichlorohydrin rubber, silicone rubber, fluorine rubber and the like. In particular, polyurethane rubber and silicone rubber are preferred as having compression set superior to that of other materials. Foams of these materials are also preferred as having superior flexibility, having less influence on the flexing properties of the electrophotographic endless and achieving stable belt travel performance.

As the position detection member in the present invention, it may include members having the form of a seal (sticker) and those provided by coating. Taking account of coating precision or squeeze-out of coating materials, those having the form of a seal (position detection seal) are preferred as being attachable with good precision, suitable for automation and able to achieve both high precision and low cost.

There are no particular limitations on the materials for a base material (support) of the position detection seal, and conventionally known materials may be used. For example, it may include sheets of paper such as kraft paper, Japanese paper and crepe paper; single or mixed woven fabrics of rayon (staple fiber), cotton, acetate, glass, polyester, Vinylon and the like; fabrics of polyethylene, polypropylene and the like; nonwoven fabrics of rayon, polypropylene, aromatic polyamide, polyester, glass; cellophane and the like; films of acetate, polyvinyl chloride, polyethylene, polypropylene, polyester and the like.

As a pressure-sensitive adhesive (bonding material) of the position detection seal, it may include rubber types such as urethane rubber, natural rubbers, styrene-butadiene rubbers, isobutylene rubbers, isoprene rubbers, a styrene-isoprene block copolymer and a styrene-butadiene block copolymer, acrylic types; and silicone types. Also, any of these materials, or any of these and other materials, may be used in a combination of two or more. Of these, a position detection seal making use of an acrylic pressure-sensitive adhesive is preferred as having superior adhesive strength.

As the construction of the position detection seal, it not only may be formed of a simplest combination of a single-layer base material and a single-layer, pressure-sensitive adhesive, but also may be constituted of a plurality of base material layers and a plurality of pressure-sensitive adhesive layers as the occasion calls for, or may be formed in multiple layers by coating or vacuum deposition.

As methods of preparing the position detection seal, conventionally known methods may be employed. A method of preparing it by punching making use of a punching cutter is preferable as promising manufacture with excellent precision, good productivity, and low cost.

The electrophotographic endless belt of the present invention is also very preferably usable as an intermediate transfer belt for a process cartridge which integrally supports an intermediate transfer belt and an electrophotographic photosensitive member and is detachably mountable to the main body of an electrophotographic apparatus (an intermediate transfer belt/electrophotographic photosensitive member integral process cartridge).

Even where the intermediate transfer belt/electrophotographic photosensitive member integral process cartridge is placed in a severe environment of high temperature and high humidity during distribution in the market in the state in which it is kept put over the rollers for a long term and, by any chance, the meandering-preventive member has caused permanent deformation to have the habit of bending, the process cartridge is by no means influenced by such deformation as long as the intermediate transfer belt, which is the electrophotographic endless belt of the present invention, is used, because the position detection member is present at a place kept apart at the specific distance from the meandering-preventive member.

Meanwhile, when used as the intermediate transfer belt/electrophotographic photosensitive member integral process cartridge, the process cartridge is handled as an article for consumption. Hence, it is an essential object that the process cartridge be more inexpensively manufactured. Accordingly, the component parts constituting it are also desired to be inexpensive. As in the present invention, the pressure-sensitive adhesive, double-coated tape commercially available at a low price may be used to attach the meandering-preventive member to the electrophotographic endless belt (intermediate transfer belt). This is preferable because the achievement of a low cost can be realized. The position detection member may also only be stuck, and this is also preferable because the achievement of a low cost can be realized.

For the purpose of making the process cartridge compact and achieving a cost reduction, it is also preferable to use as a cleaning system of the intermediate transfer belt, a cleaning-at-primary transfer method in which secondary-transfer residual toner is charged to a polarity reverse to that at the time of primary transfer and returned from the surface of the intermediate transfer belt to the latent-image-bearing member simultaneously with the primary transfer.

Stated specifically, it is a system in which electric charges with a polarity reverse to that at the time of primary transfer are imparted to the secondary-transfer residual toner by applying a voltage to a charge-providing means (e.g., a charge-providing roller) disposed separably on the intermediate transfer belt, and are returned to the electrophotographic photosensitive member with the aid of a primary-transfer electric field at the subsequent primary-transfer zone. Of course, as the charge-providing means, a corona charging assembly or blade or the like may be used besides the roller. Any means having any shape may be used as long as the electric charges can be imparted to the secondary-transfer residual toner remaining on the intermediate transfer belt.

The toner returned from the surface of the intermediate transfer belt to the electrophotographic photosensitive member is removed by a cleaning means for the electrophotographic photosensitive member, such as a cleaning blade. This system is greatly effective to make the cartridge compact and low-cost.

The intermediate transfer belt may also preferably be of a system in which it is put over two rollers, in view of such an advantage that the drive mechanism is simple, the number of component parts can be made small, and the cartridge can be made compact.

Of the rollers over which the intermediate transfer belt is put, a tension roller which applies a tension to the intermediate transfer belt may preferably be slidable by at least 1 mm with respect to the direction in which the intermediate transfer belt is elongated. Also, in order for the intermediate transfer belt to be surely driven without slipping, the intermediate transfer belt may preferably be put over the rollers with a force of 5 N or more.

An electrophotographic apparatus is specifically described below which has an intermediate transfer belt/electrophotographic photosensitive member integral process cartridge making use of the electrophotographic endless belt as the intermediate transfer belt.

Figure 1:
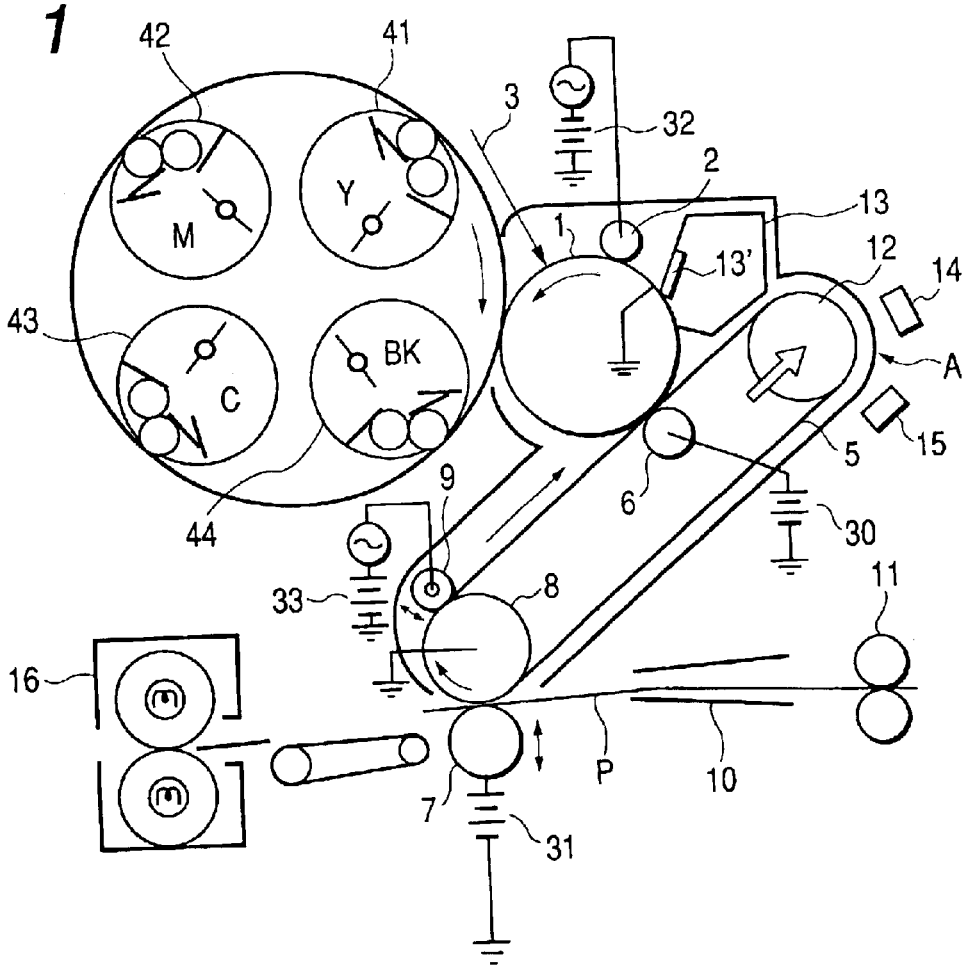
FIG. 1 is a schematic view showing an example of the construction of an electrophotographic apparatus having an intermediate transfer belt/electrophotographic photosensitive member integral process cartridge of the present invention.

FIG. 1 is a schematic view showing an example of the construction of an electrophotographic apparatus having an intermediate transfer belt/electrophotographic photosensitive member integral process cartridge (FIG. 2 as referred to later) of the present invention.

In the apparatus shown in FIG. 1, a drum-shaped electrophotographic photosensitive member (photosensitive drum) 1 is rotatably driven at a prescribed peripheral speed (process speed) in the direction of an arrow.

The electrophotographic photosensitive member 1 is, in the course of its rotation, uniformly charged to prescribed polarity and potential by means of a roller-shaped (primary-) charging means (charging roller) 2. Reference numeral 32 denotes a power source for the charging means. A bias formed by superimposing an alternating current on a direct current may be applied, or only a direct-current voltage may be applied.

Subsequently, the electrophotographic photosensitive member is subjected to exposure light 3 by an exposure means (not shown; e.g., a color original image color-separating/image-forming optical system, or a scanning exposure system comprising a laser scanner that outputs laser beams modulated in accordance with time-sequential electrical digital pixel signals of image information). Thus, an electrostatic latent image is formed which corresponds to a first color component image (e.g., a yellow color component image) of the intended full-color image.

Next, the electrostatic latent image is developed with a first-color yellow toner Y by means of a first developing means (yellow color developing means 41) to form a yellow toner image. At this stage, second to fourth developing means (magenta color developing means 42, cyan color developing means 43 and black color developing means 44) each stand unoperated and do not act on the electrophotographic photosensitive member 1, and hence the first-color yellow toner image is not affected by the second to fourth developing means.

An intermediate transfer belt 5 is rotatably driven in the direction of an arrow at the same peripheral speed as the electrophotographic photosensitive member 1. The first-color yellow toner image formed and held on the electrophotographic photosensitive member 1 passes through a contact zone between the electrophotographic photosensitive member 1 and the intermediate transfer belt 5, in the course of which it is successively primarily transferred to the outer periphery of the intermediate transfer belt 5 with the aid of an electric field formed by a primary-transfer bias applied from a roller-shaped primary-transfer means (primary-transfer roller) 6 to the intermediate transfer belt 5.

The surface of the electrophotographic photosensitive member 1, from which the corresponding first-color yellow toner image has been transferred to the intermediate transfer belt 5, is cleaned by an electrophotographic photosensitive member cleaning means 13 having a cleaning blade 13'.

Then, the second-color magenta toner image, the third-color magenta toner image and the fourth-color black toner image are sequentially likewise transferred superimposingly onto the intermediate transfer belt 5. Thus, a synthesized full-color toner image corresponding to the intended full-color image is formed on the intermediate transfer belt 5.

Here, the position of the intermediate transfer belt is detected .by a position detection sensor 15. The patch for controlling density is also detected by a density detection sensor 14.

A roller-shaped secondary-transfer means (secondary-transfer roller) 7 is provided in such a state that it is axially supported correspondingly, and in parallel, to a secondary-transfer opposing roller 8 and stands separable from the bottom surface of the intermediate transfer belt 5.

The primary transfer bias for sequentially superimposingly transferring the first- to fourth-color toner images from the electrophotographic photosensitive member 1 to the intermediate transfer belt 5 is applied from a bias power source 30 at a polarity (+) reverse to that of each toner. The voltage thus applied may preferably be in the range of from +100 V to +2 kV.

In the step of primarily transferring the first- to third-color toner images from the electrophotographic photosensitive member 1 to the intermediate transfer belt 5, the secondary-transfer roller 7 may also be made to stand separate from the intermediate transfer belt 5.

The synthesized full-color toner image having been transferred onto the intermediate transfer belt 5 is transferred to a second image-bearing member transfer material P in the following way: The secondary transfer roller 7 is brought into contact with the intermediate transfer belt 5 and simultaneously the transfer material P is fed at a prescribed timing from a roller-shaped paper feed means (paper feed roller) 11 through a transfer material guide 10 to the contact zone formed between the intermediate transfer belt 5 and the secondary-transfer roller 7, where a secondary-transfer bias is applied to the secondary-transfer roller 7 from a power source 31. Upon application of this secondary-transfer bias, the synthesized full-color toner image is secondarily transferred from the intermediate transfer belt 5 to the second image-bearing member transfer material P. The transfer material P to which the synthesized full-color toner image has been transferred is guided into a roller-shaped fixing means (fixing roller) 16 and is heat-fixed there.

After the synthesized full-color toner image has been transferred to the transfer material P, a roller-shaped charge-providing means (charge-providing roller) 9 disposed separably is brought into contact with the intermediate transfer belt 5, and a bias with a polarity reverse to that of the electrophotographic photosensitive member 1 is applied, whereupon electric charges with a polarity reverse to that at the time of primary transfer are imparted to secondary-transfer residual toners, not transferred to the transfer material P and remaining on the intermediate transfer belt 5. Reference numeral 33 denotes a bias power source. Here, a bias formed by superimposing an alternating current on a direct current is applied.

The secondary-transfer residual toners charged to the polarity reverse to that at the time of primary transfer are electrostatically transferred to the electrophotographic photosensitive member 1 at the contact zone formed between the intermediate transfer belt 5 and the electrophotographic photosensitive member 1 and the vicinity thereof, thus the intermediate transfer belt 5 is cleaned. This step can be carried out simultaneously with the primary transfer, and hence the throughput does not decrease.

The intermediate transfer belt/electrophotographic photosensitive member integral process cartridge of the present invention, which is mounted to the electrophotographic apparatus shown in FIG. 1, is described below in greater detail.

Figure 2:
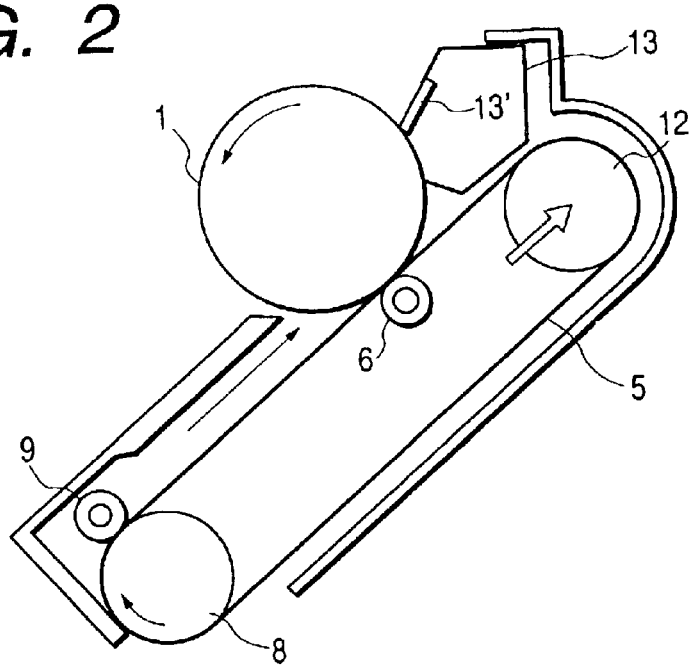
FIG. 2 is a schematic view showing an example of the construction of an intermediate transfer belt/electrophotographic photosensitive member integral process cartridge of the present invention.

FIG. 2 is a schematic view showing an example of the construction of the process cartridge of the present invention.

In the process cartridge shown in FIG. 2, at least an intermediate transfer belt 5, an electrophotographic photosensitive member 1, an electrophotographic photosensitive member cleaning means 13 having a cleaning blade 13' and a charge-providing means (charge-providing roller) 9 integrally constitute one unit so that it is detachably mountable to the main body of the electrophotographic apparatus.

The cleaning of the intermediate transfer belt 5 employs a system in which the secondary-transfer residual toners are charged to a polarity reverse to that at the time of primary transfer as described previously and thereby returned from the intermediate transfer belt to the electrophotographic photosensitive member at the contact zone between the intermediate transfer belt and the electrophotographic photosensitive member. In the process cartridge shown in FIG. 2, a roller-shaped charge-providing means (charge-providing roller) 9 comprised of a medium-resistance elastic body is provided. Then, the cleaning of the electrophotographic photosensitive member is performed by the cleaning blade 13'. A waste-toner container (not shown) is also integrally provided so that the transfer residual toners on both the intermediate transfer belt and the electrophotographic photosensitive member can simultaneously be discarded when the process cartridge is replaced. Thus, it contributes to an improvement in maintenance performance.

The intermediate transfer belt 5 is also put over two rollers, a secondary-transfer opposing roller 8 and a tension roller 12 so that the number of component parts can be made small and the cartridge can be made compact.

Here, the secondary-transfer opposing roller 8 is a drive roller for driving the intermediate transfer belt and at the same time an opposing roller of the charge-providing roller 9. The tension roller 12, which rotates following the intermediate transfer belt, has a sliding mechanism, and is brought into pressure contact with the inside of the belt in the direction of an arrow by the action of a compression spring to impart a tension to the intermediate transfer belt. It may preferably be slidable in a slide width of from 1 to 5 mm, and the spring may preferably apply a pressure of from 5 to 70 N in total. Also, the electrophotographic photosensitive member 1 and the secondary-transfer opposing roller 8 (serving also as a drive roller) have a coupling (not shown) between them so that the rotational driving force is transmitted from the main body.

In FIGS. 1 and 2, the secondary-transfer opposing roller 8 (serving also as a drive roller) is also a roller provided on one end in the axial direction thereof with a terraced portion in which the meandering-preventive member of the intermediate transfer belt fits. The tension roller 12 is also a roller provided over the whole outer periphery thereof with a groove that may fit in the cross-sectional shape of the meandering-preventive member of the intermediate transfer belt.

The intermediate transfer belt/electrophotographic photosensitive member integral process cartridge shown in FIG. 2 may be integral at least at the time it is used by users. Taking account of the handling in the course of its manufacture and the readiness to disassemble them after recovery, it is preferable for it to be so designed that it can be divided into some units, e.g., an intermediate transfer belt unit having the intermediate transfer belt and an electrophotographic photosensitive member unit having the electrophotographic photosensitive member.

As a position detection means for detecting the position detection member provided on the electrophotographic endless belt, a conventionally known method may be used. In particular, in the present inventions, it is preferable to use, e.g., a photoelectric sensor (position detection sensor) making use of visible light rays, infrared rays or the like, and in particular, a reflection type position detection sensor. If a transmission type sensor is used as the position detection sensor of the electrophotographic endless belt, there are restrictions on materials for the intermediate transfer belt. Especially in the case of the intermediate transfer belt/electrophotographic photosensitive member integral process cartridge as in the present invention, the light-projection part and light-receiving part of the position detection sensor must be put separately on the electrophotographic apparatus main body side and on the process cartridge side. This not only may lower detection precision but also may cause a rise in cost of the process cartridge.

In the foregoing, the present invention has been described mainly in the case in which the electrophotographic endless belt is used as the intermediate transfer belt. Besides the intermediate transfer belt, the electrophotographic endless belt of the present invention is also applicable to belts at large for which the prevention of meandering and the detection of position are required, such as photosensitive belts, transfer belts, transport belts and fixing belts.

The characteristics of the present invention are all measured in the following manner.

Measurement of Spectral Reflectance:

The spectral reflectance of the electrophotographic endless belt of the present invention and the position detection member used therein refers to spectral reflectance to light of 880 nm in wavelength, and is the value found by measurement with a spectrophotometer UV-310, trade name, manufactured by Shimadzu Corporation (a large-size integrating sphere attachment instrument). Here, its slit width is set to be 5.0 nm, and the sampling pitch is 2.0 nm.

Measurement of Glossiness:

The glossiness of the intermediate transfer belt is the value found by measuring with a Handy Gloss Meter IG-320 (trade name, manufactured by Horiba Seisakusho K. K.) the glossiness at four spots taken at equal intervals in the peripheral direction at the middle of the belt and averaging the measurements.

Measurement of Layer Thickness:

The layer thickness of the colored layer (belt-like substrate) of the electrophotographic endless belt (intermediate transfer belt) is found, in the case of a single layer, by measuring with a dial gauge the cross sections of samples cut at eight spots at equal intervals over the whole periphery of the middle of the bell and averaging the measurements, and in the case of multiple layers, by observing and measuring such cross sections with an optical microscope and averaging the measurements.

The present invention is described below in greater detail by giving specific working examples. In the following Examples, "part(s)" means part(s) by weight.

EXAMPLE 1

| | |
|---|---|
| Polyvinylidene fluoride resin (KEINER 720, trade name; available from Elfatochem Co.) | 69.7 parts |
| Polyether ester amide (PELESTAT NC6321, trade name; available from Sanyo Kasei Kogyo K. K.) | 10 parts |
| Potassium perfluorosulfonate | 0.3 part |
| Zinc oxide particles (volume-average particle diameter: 0.5 μm) | 20 parts |

Materials formulated as above were melt-kneaded at 210° C. by means of a twin-screw extruder to mix them, and the kneaded product obtained was extruded in the shape of strands of about 2 mm in diameter, followed by cutting into pellets. This is designated as an extrusion material 1. A belt-like substrate of an intermediate transfer belt was formed by means of the blown-film extrusion apparatus (inflation apparatus) shown in FIG. 4.

In the extrusion apparatus shown in FIG. 4, the extruder die 103 was set as a single-layer circular die, where a die slit outer diameter was 100 mm. The die slit was 0.8 mm in width.

The above extrusion material, having been well dried by heating, was put into the hopper 102 of this extrusion apparatus, and heated and melted. The molten product obtained was extruded at 210° C. from the circular die 103. The outside-cooling ring 105 is provided around the circular die 103, and air was blown from the circumference to the film extruded in a tubular form to effect cooling. Also, air was blown to the interior of the extruded tubular film through the gas inlet passage 104 to cause the film to inflate while scaling up until it came to have a diameter of 140 mm. Thereafter, the film was continuously drawn off at a constant speed by means of the draw-off unit. The proportion of the diameter of the circular die 103 to the diameter of the tubular film extruded came to 140%. Here, the air was stopped being fed at the time the diameter came to the desired value. Then, subsequent to the draw-off through the pinch rollers, the tubular film was cut with the cutter 108. After its thickness became uniform, the film was cut at a length of 280 mm to form a tubular film.

On this tubular film, its size and surface smoothness were regulated and folds were removed, using a set of cylindrical forms made of metals having different coefficients of thermal expansion. The tubular film was placed over the cylindrical form (inner form) having a higher coefficient of thermal expansion, and this inner form with film was inserted into the cylindrical form (outer form) having been worked to have a smooth inner surface, followed by heating at 170° C. for 20 minutes. After cooling to room temperature, the tubular film was removed from the inner and outer forms, thus obtaining a tubular film whose size and surface smoothness were regulated and from which folds were removed.

Both ends of this tubular film were precisely cut away to obtain a belt-like substrate of 242 mm in width.

The spectral reflectance of this belt-like substrate was 70%. Also, in this belt-like substrate, the zinc oxide particles stood dispersed in its whole thickness direction, and the belt-like substrate was formed as a white colored layer. The thickness of the colored layer of this belt-like substrate was equal to the thickness of the belt-like substrate itself and was 80 μm. Also, the glossiness of this belt-like substrate was 70.

A pressure-sensitive adhesive, double-coated tape, comprised of a nonwoven fabric base material of 50 μm in thickness on one side an acrylic pressure-sensitive adhesive on the other side was provided, respectively, at the thickness of 55 μm and 155 μm, and was stuck to a polyurethane foam of 1.5 mm in thickness in such a way that the 155 μm thick adhesive side was on the polyurethane foam side, and these were cut to a width of 5 mm and a length of 436 mm to make a meandering-preventive member.

Then, a polyethylene terephthalate (PET) film, 50 μm in thickness on one side, having a black coating, and having an acrylic pressure-sensitive adhesive (20 μm thick) on the other side, was punched out in a 10 mm length×10 mm width to make a position detection seal as the position detection member. The position detection seal was black, and had a spectral reflectance of 8%.

The above meandering-preventive member was attached to one end portion of the belt-like substrate obtained by extrusion as described above, and in the peripheral direction of the inner periphery of the belt-like substrate at a position 4 min shifted to the middle from the end.

On the outer periphery of the belt-like substrate at its end portion opposite to the end portion to which the meandering-preventive member was attached, the above position detection seal was further stuck along the former's end, at four spots at equal intervals in the peripheral direction of the belt-like substrate, thus obtaining an intermediate transfer belt. The distance between the meandering-preventive member and the position detection seal (position detection member) in the width direction was 223 mm. The meandering-preventive member and the position detection member were both attached at the non-image formation region.

Image Evaluation:

The intermediate transfer belt thus obtained was set in the electrophotographic apparatus constructed as shown in FIG. 1, and full-color images were reproduced on paper of 80 $g/m^2$ (basis weight) to conduct a print test. An exposure unit used here was a 600 dpi digital laser system.

The extent of color misregistration of the images formed was measured to make an evaluation. In general, color misregistration to an extent of more than 150 μm is perceivable even with the naked eye. Accordingly, when the extent of color misregistration was more than 150 μm, it was judged that the effect of the present invention had not been obtained.

As a result, the extent of color misregistration was sufficiently as small as 20 μm, and good full-color images were formed. Also, the density was detectable with respect of all densities in all the black, yellow, magenta and cyan colors, and development bias conditioning the image formation process was well controllable, so that images with a proper density were formed.

Subsequently, a running test was conducted by continuous printing on 5,000 sheets at a process speed of 4 sheets per minute to make an image evaluation in the same way. As a result, good images almost free of color misregistration like those at the initial stage were formed. Also, the density was detectable with respect to all densities in all the black, yellow, magenta and cyan colors like those at the initial stage, and development bias conditioning the image formation operation was well controllable. Thus, it was confirmed that this intermediate transfer belt had good performance. Any color misregistration that had gone beyond tolerance limits did not occur in printing at the initial stage and in the course of running, and images with proper density were formed.

EXAMPLE 2

| | |
|---|---|
| Polycarbonate resin | 70 parts |
| Polyether ester amide (PELESTAT NC6321) | 10 parts |
| Titanium oxide particles (volume-average particle diameter: 0.05 μm) | 20 parts |

A belt-like substrate of the intermediate transfer belt was obtained in the same manner as in Example 1 except that the formulation of the extrusion material was changed as shown above and it was made in a belt width of 260 mm.

The same meandering-preventive member and position detection member as those in Example 1 were used.

The meandering-preventive member was attached to one end portion of the belt-like substrate obtained by extrusion as described above, and in the peripheral direction of the inner periphery of the belt-like substrate at a position 5 mm shifted to the middle from the end.

On the outer periphery of the belt-like substrate at its end portion opposite to the end portion to which the meandering-preventive member was attached, the position detection seal was further stuck along the former's end, at four spots at equal intervals in the peripheral direction of the belt-like substrate, thus obtaining an intermediate transfer belt. The distance between the meandering-preventive member and the position detection seal (position detection member) in the width direction was 240 mm. The meandering-preventive member and the position detection member were both attached at the non-image formation region.

The spectral reflectance of the belt-like substrate obtained was 68%. Also, its glossiness was 40. The layer thickness of the colored layer, i.e., belt-like substrate was 80 μm.

The intermediate transfer belt obtained was set in the electrophotographic apparatus constructed as shown in FIG. 1, and an image print test was conducted in the same manner as in Example 1. As a result, the extent of color misregistration was sufficiently as small as 30 μm, and good full-color images were formed. Also, the density was detectable with respect of all densities in all the black, yellow, magenta and cyan colors, and development bias conditioning the image formation process was well controllable, so that images with a proper density were formed.

Subsequently, a running test was conducted by continuous printing on 5,000 sheets at a process speed of 4 sheets per minute to make an image evaluation in the same way. As a result, good images almost free of color misregistration like those at the initial stage were formed. Also, the density was detectable with respect to all densities in all the black, yellow, magenta and cyan colors like those at the initial stage, and development bias conditioning of the image formation process was well controllable. Thus, it was confirmed that this intermediate transfer belt had good performance. Any color misregistration that had gone beyond tolerance limits did not occur in printing at the initial stage and in the course of running, and images with proper density were formed.

EXAMPLE 3

| | |
|---|---|
| Polyvinylidene fluoride resin (KEINER 740, trade name; available from Elfatochem Co.) | 70 parts |
| Potassium perfluorosulfonate (conductive agent) | 8 parts |
| Tin-oxide-coated conductive titanium oxide particles (volume-average particle diameter: 0.02 μm) | 12 parts |
| Zinc oxide particles (volume-average particle diameter: 0.5 μm) | 10 parts |

A belt-like substrate of the intermediate transfer belt was obtained in the same manner as in Example 1 except that the formulation of materials for extrusion was changed as shown above. It was in a belt width of 242 mm.

The same meandering-preventive member as that in Example 1 was used.

The meandering-preventive member was attached to one end portion of the belt-like substrate obtained by extrusion as described above, and in the peripheral direction of the inner periphery of the belt-like substrate at a position 5 mm shifted to the middle from the end.

At four spots at equal intervals on the outer periphery of the belt-like substrate at its end portion opposite to the end portion to which the meandering-preventive member was attached, a black coating material was further applied in a 10 mm square each to make them serve as the position detection member, thus obtaining an intermediate transfer belt. The distance between the meandering-preventive member and the position detection seal (position detection member) in the width direction was 222 mm. The meandering-preventive member and the position detection member were both attached at the non-image formation region.

The spectral reflectance of the belt-like substrate obtained was 62%. Also, its glossiness was 64.2. The layer thickness was 100 μm. The spectral reflectance of the position detection member was 10%.

The intermediate transfer belt obtained was set in the electrophotographic apparatus constructed as shown in FIG. 1, and an image print test was conducted in the same manner as in Example 1. As a result, the extent of color misregistration was sufficiently as small as 40 μm, and good full-color images were formed. Also, the density was detectable with respect to all densities in all the black, yellow, magenta and cyan colors, and development bias conditioning the image formation process was well controllable, so that images with a proper density were formed.

Subsequently, a running test was conducted by continuous printing on 5,000 sheets at a process speed of 4 sheets per minute to make an image evaluation in the same way. As the result, good images almost free of color misregistration like those at the initial stage were formed. Also, the density was detectable with respect to all densities in all the black, yellow, magenta and cyan colors like those at the initial stage, and development bias conditioning the image formation process was well controllable. Thus, it was confirmed that this intermediate transfer belt had good performance. Any color misregistration that had gone beyond tolerance limits did not occur in printing at the initial stage and in the course of running, and images with a proper density were formed.

EXAMPLE 4

| | |
|---|---|
| Polyvinylidene fluoride resin (KEINER 720) | 99 parts |
| Lithium perchlorate powder | 1 part |

An inside tubular film was obtained in the same manner as the belt-like substrate in Example 1 except that the formulation of materials for extrusion was changed as shown above and it was formed in a layer thickness of 70 μm.

An outside tubular film was also obtained in the same manner as the belt-like substrate in Example 1 except that materials for extrusion formulated as shown below were used and it was formed in a layer thickness of 30 μm.

| | |
|---|---|
| Polyvinylidene fluoride resin (KEINER 720) | 70 parts |
| Polyether ester amide (PELESTAT NC6321) | 10 parts |
| Zinc oxide particles (volume-average particle diameter: 0.5 μm) | 20 parts |

A belt-like substrate was obtained in the same manner as in Example 1 except that the inside tubular film and the outside tubular film were so superposed that the former was on the inside and the latter was on the outside and these films were joined together and adjusted on their sizes and surface smoothnesses, using a set of cylindrical forms made of a metal, having different coefficients of thermal expansion. It was in a belt width of 242 mm.

The same meandering-preventive member and position detection member as those in Example 1 were used.

The meandering-preventive member was attached to one end portion of the belt-like substrate obtained by extrusion as described above, and in the peripheral direction of the inner periphery of the belt-like substrate at a position 5 mm shifted to the middle from the end.

On the outer periphery of the belt-like substrate at its end portion opposite to the end portion to which the meandering-preventive member was attached, the position detection seal was further stuck along the former's end, at four spots at equal intervals in the peripheral direction of the belt-like substrate, thus obtaining an intermediate transfer belt. The distance between the meandering-preventive member and the position detection seal (position detection member) in the width direction was 222 mm. The meandering-preventive member and the position detection member were both attached at the non-image formation region.

The spectral reflectance of the belt-like substrate obtained was 52% because the thickness of the colored layer (colorant-containing layer) formed out of the above outside tubular film was so small that most incident light was transmitted. Also, its glossiness was 67. The layer thickness of the colorant-containing layer was 30 μm. The spectral reflectance of the position detection member was 8%.

The intermediate transfer belt obtained was set in the electrophotographic apparatus constructed as shown in FIG. 1, and an image print test was conducted in the same manner as in Example 1. As a result, the extent of color misregistration was sufficiently as small as 45 μm, and good full-color images were formed. Also, though not as good as in Example 1, the density was detectable with respect to all densities in all the black, yellow, magenta and cyan colors, and the development bias conditioning the image formation process was well controllable, so that images with a proper density were formed.

Subsequently, a running test was conducted by continuous printing on 5,000 sheets at a process speed of 4 sheets per minute to make an image evaluation in the same way. As a result, good images almost free of color misregistration like those at the initial stage were formed. Also, the density was detectable with respect to all densities in all the black, yellow, magenta and cyan colors like those at the initial stage, and development bias conditioning the image formation process was well controllable. Thus, it was confirmed that this intermediate transfer belt had good performance. Any color misregistration that had gone beyond tolerance limits did not occur in printing at the initial stage and in the course of running, and images with a proper density were formed.

EXAMPLE 5

A belt-like substrate was obtained in the same manner as in Example 1. As the meandering-preventive member, the same one as in Example 1 was attached to the same position. Also, as the position detection member, it was provided in the same manner as in Example 1 except that it was formed by applying a gray coating material. Thus, an intermediate transfer belt was obtained.

The spectral reflectance of this position detection member was 67%. The spectral reflectance of the position detection member was lower than the spectral reflectance of the belt-like substrate, and the difference between them was 3. Also, the glossiness of the belt-like substrate was 70.

The intermediate transfer belt obtained was set in the electrophotographic apparatus constructed as shown in FIG. 1, and an image print test was conducted in the same manner as in Example 1. As a result, the extent of color misregistration was sufficiently as small as 70 μm, and good full-color images were formed. Also, the density was detectable with respect to all densities in all the black, yellow, magenta and cyan colors, and development bias conditioning the image formation process was well controllable, so that images with a proper density were formed.

Subsequently, a running test was conducted by continuous printing on 5,000 sheets at a process speed of 4 sheets per minute to make an image evaluation in the same way. As a result, good images almost free of color misregistration like those at the initial stage were formed. Also, the density was detectable with respect to all densities in all the black, yellow, magenta and cyan colors like those at the initial stage, and development bias conditioning of the image formation process was well controllable. Thus, it was confirmed that this intermediate transfer belt had good performance. Any color misregistration that had gone beyond tolerance limits did not occur in printing at the initial stage and in the course of running, and images with a proper density were formed.

EXAMPLE 6

A belt-like substrate was obtained in the same manner as in Example 1. As the meandering-preventive member, the same one as in Example 1 was attached to the same position. Also, as the position detection member, it was provided in the same manner as in Example 1 except that the PET film was vacuum-deposited with aluminum. Thus, an intermediate transfer belt was obtained.

The spectral reflectance of this position detection member was 80%. The spectral reflectance of the position detection member was higher than the spectral reflectance of the belt-like substrate, and the difference between them was 10. Also, the glossiness of the belt-like substrate was 70.

The intermediate transfer belt obtained was set in the electrophotographic apparatus constructed as shown in FIG. 1, and an image print test was conducted in the same manner as in Example 1. As a result, although the sequence on the side of the main body of the electrophotographic apparatus had to be rewritten because the spectral reflectance of the position detection member and that of the belt-like substrate stood reverse, the extent of color misregistration was sufficiently as small as 70 μm, and good full-color images were formed. Also, the density was detectable with respect to all densities in all the black, yellow, magenta and cyan colors, and development bias conditioning the image formation process was well controllable, so that images with a proper density were formed.

Subsequently, a running test was conducted by continuous printing on 5,000 sheets at a process speed of 4 sheets per minute to make an image evaluation in the same way. As a result, good images almost free of color misregistration like those at the initial stage were formed. Also, the density was detectable with respect to all densities in all the black, yellow, magenta and cyan colors like those at the initial stage, and development bias conditioning the image formation process was well controllable. Thus, it was confirmed that this intermediate transfer belt had good performance. Any color misregistration that had gone beyond tolerance limits did not occur in printing at the initial stage and in the course of running, and images with a proper density were formed.

EXAMPLE 7

A belt-like substrate was obtained in the same manner as in Example 1 except that it was made in a thickness of 250 μm as the colored layer. The same meandering-preventive member and position detection member as those in Example 1 were attached to the same positions to obtain an intermediate transfer belt.

The spectral reflectance of this belt-like substrate was 74%. Also, the glossiness of the belt-like substrate was 70.

The intermediate transfer belt obtained was set in the electrophotographic apparatus constructed as shown in FIG. 1, and an image print test was conducted in the same manner as in Example 1. As a result, although the belt was so thick as to have poor flexing properties to make position detection unstable, the extent of color misregistration was 90 μm, and the belt was well usable. Also, the density was detectable with respect to all densities in all the black, yellow, magenta and cyan colors, and development bias conditioning the image formation process was well controllable, so that images with a proper density were formed.

Subsequently, a running test was conducted by continuous printing on 5,000 sheets at a process speed of 4 sheets per minute to make an image evaluation in the same way. As a result, good images almost free of color misregistration like those at the initial stage were formed. Also, the density was detectable with respect to all densities in all the black, yellow, magenta and cyan colors like those at the initial stage, and development bias conditioning the image formation process was well controllable. Thus, it was confirmed that this intermediate transfer belt had good performance. Any color misregistration that had gone beyond tolerance limits did not occur in printing at the initial stage and in the course of running, and images with a proper density were formed.

EXAMPLE 8

A belt-like substrate was obtained in the same manner as in Example 1 except that it was made in a thickness of 150 μm as the colored layer. The same meandering-preventive member and position detection member as those in Example 1 were attached to the same positions to obtain an intermediate transfer belt.

The spectral reflectance of this belt-like substrate was 72%. Also, the glossiness of the belt-like substrate was 70.

The intermediate transfer belt obtained was set in the electrophotographic apparatus constructed as shown in FIG. 1, and an image print test was conducted in the same manner as in Example 1. As a result, the extent of color misregistration was 70 μm, which was on a good level. Also, the density was detectable with respect all densities in all the black, yellow, magenta and cyan colors, and development bias conditioning the image formation process was well controllable, so that images with a proper density were formed.

Subsequently, a running test was conducted by continuous printing on 5,000 sheets at a process speed of 4 sheets per minute to make an image evaluation in the same way. As a result, good images almost free of color misregistration like those at the initial stage were formed. Also, the density was detectable with respect to all densities in all the black, yellow, magenta and cyan colors like those at the initial stage, and development bias conditioning the image formation process was well controllable. Thus, it was confirmed that this intermediate transfer belt had good performance. Any color misregistration that had gone beyond tolerance limits did not occur in printing at the initial stage and in the course of running, and images with a proper density were formed.

EXAMPLE 9

| | |
|---|---|
| Polyvinylidene fluoride resin (KEINER 720) | 69.7 parts |
| Polyether ester amide (PELESTAT NC6321) | 10 parts |
| Potassium perfluorosulfonate | 0.3 part |
| Carbon black for coloring | 20 parts |

A belt-like substrate of the intermediate transfer belt was obtained in the same manner as in Example 1 except that the formulation of materials for extrusion was changed as shown above. The same meandering-preventive member and position detection member as in Example 1 were attached to the same positions to obtain an intermediate transfer belt.

The spectral reflectance of this belt-like substrate was 15%. Also, the glossiness of the belt-like substrate was 50.

The intermediate transfer belt obtained was set in the electrophotographic apparatus constructed as shown in FIG. 1, and an image print test was conducted in the same manner as in Example 1. As a result, the extent of color misregistration was 70 μm, which was on a good level. Also, the density deviated a little from the desired density because of a small low spectral reflectance of the belt, but images with a density within a well usable range were formed.

Subsequently, a running test was conducted by continuous printing on 5,000 sheets at a process speed of 4 sheets per minute to make an image evaluation in the same way. As a result, good images almost free of color misregistration like those at the initial stage were formed. Any color misregistration that had gone beyond tolerance limits did not occur in printing at the initial stage and in the course of running, and the image density was also within a well usable range.

EXAMPLE 10

A belt-like substrate was obtained in the same manner as in Example 1 except that an outer form whose inner surface was subjected to honing was used. The same meandering-preventive member and position detection member as those in Example 1 were attached to the same positions to obtain an intermediate transfer belt.

The spectral reflectance of this belt-like substrate was 65%. Also, the glossiness of the belt-like substrate was as low as 30 because the inner surface of the outer form had a little large surface roughness.

The intermediate transfer belt obtained was set in the electrophotographic apparatus constructed as shown in FIG. 1, and an image print test was conducted in the same manner as in Example 1. As the result, the extent of color misregistration was 70 μm, which was on a good level. Also, the density deviated a little from the desired density because of a little low glossiness of the belt, but images with a density within a well usable range were formed.

Subsequently, a running test was conducted by continuous printing on 5,000 sheets at a process speed of 4 sheets per minute to make an image evaluation in the same way. As the result, good images almost free of color misregistration like those at the initial stage were formed. Also, the image density was within a well usable range. Thus, it was confirmed that this intermediate transfer belt had good performance. Any color misregistration that had gone beyond tolerance limits did not occur in printing at the initial stage and in the course of running, and image density was also within a well usable range.

COMPARATIVE EXAMPLE 1

The same belt-like substrate, meandering-preventive member and position detection member as in Example 1 were used.

The meandering-preventive member was attached to one end portion of the belt-like substrate obtained by extrusion as described above, and in the peripheral direction of the inner periphery of the belt-like substrate at a position 3 mm shifted to the middle from the end.

On the outer periphery of the belt-like substrate at its end portion to which the meandering-preventive member was attached, the position detection seal was further stuck along the former's end, at four spots at equal intervals in the peripheral direction of the belt-like substrate, thus obtaining an intermediate transfer belt. The meandering-preventive member and the position detection seal (position detection member) were on the inside and outside of the same end portion. The meandering-preventive member and the position detection member were both attached at the non-image formation region.

The intermediate transfer belt obtained was set in the electrophotographic apparatus constructed as shown in FIG. 1, and an image print test was conducted in the same manner as in Example 1. As a result, although the image density was proper, the extent of color misregistration was 200 μm from the beginning, which had gone beyond tolerance limits.

COMPARATIVE EXAMPLE 2

Polycarbonate resin 85 parts
Conductive carbon black (primary average particle diameter: 40 nm) 15 parts A belt-like substrate of the intermediate transfer belt was obtained in the same manner as in Example 1 except that the formulation of the extrusion material was changed as shown above. It was made in a belt width of 242 mm.

The same meandering-preventive member and position detection member as in Example 1 were used.

The meandering-preventive member was attached to one end portion of the belt-like substrate obtained by extrusion as described above, and in the peripheral direction of the inner periphery of the belt-like substrate at a position 3 mm shifted to the middle from the end.

On the outer periphery of the belt-like substrate at its end portion to which the meandering-preventive member was attached, the position detection seal was further stuck along the former's end, at four spots at equal intervals in the peripheral direction of the belt-like substrate, thus obtaining an intermediate transfer belt. The meandering-preventive member and the position detection seal (position detection member) were on the inside and outside at the same end portion. The meandering-preventive member and the position detection member were both attached at the non-image formation region.

The belt-like substrate obtained had a layer thickness of 100 μm, a spectral reflectance 12% and a glossiness of 60.

The intermediate transfer belt obtained was set in the electrophotographic apparatus constructed as shown in FIG. 1, and a full-color image print test was conducted in the same manner as in Example 1. As a result, the position of the intermediate transfer belt was not detectable, and the printing was not performable.

COMPARATIVE EXAMPLE 3

| | |
|---|---|
| Polyvinylidene fluoride resin (KEINER 720) | 99 parts |
| Lithium perchlorate particles | 1 part |

An inside tubular film was obtained in the same manner as the belt-like substrate in Example 1 except that the formulation of materials for extrusion was changed as shown above and it was formed in a layer thickness of 70 μm.

An outside tubular film was also obtained in the same manner as the belt-like substrate in Example 1 except that materials for extrusion formulated as shown below were used and it was formed in a layer thickness of 30 μm.

| | |
|---|---|
| Polyvinylidene fluoride resin (KEINER 720) | 70 parts |
| Polyether ester amide (PELESTAT NC6321) | 10 parts |
| Zinc oxide particles (volume-average particle diameter: 0.5 μm) | 20 parts |

A belt-like substrate was obtained in the same manner as in Example 1 except that the inside tubular film and the outside tubular film were so superposed that the former was on the inside and the latter was on the outside and these films were joined together and adjusted on their sizes and surface smoothnesses, using a set of cylindrical forms made of a metal, having different coefficients of thermal expansion. It was in a belt width of 242 mm.

The spectral reflectance of the belt-like substrate obtained was 20%, its glossiness was 66, and the layer thickness of the colored layer formed of the above tubular film for outside was 30 μm.

The same meandering-preventive member and position detection member as those in Example 1 were used.

The meandering-preventive member was attached to one end portion of the belt-like substrate obtained by extrusion as described above, and in the peripheral direction of the inner periphery of the belt-like substrate at a position 3 mm shifted to the middle from the end.

On the outer periphery of the belt-like substrate at its end portion to which the meandering-preventive member was attached, the position detection seal was further stuck along the former's end, at four spots at equal intervals in the peripheral direction of the belt-like substrate, thus obtaining an intermediate transfer belt. The meandering-preventive member and the position detection seal (position detection member) were on the inside and outside at the same end portion. The meandering-preventive member and the position detection member were both attached at the non-image formation region.

The intermediate transfer belt obtained was set in the electrophotographic apparatus constructed as shown in FIG.

1, and a full-color image print test was conducted in the same manner as in Example 1. As a result, the extent of color misregistration was 300 μm, and the density of black was not within a proper range.

COMPARATIVE EXAMPLE 4

A belt-like substrate was obtained in the same manner as in Example 1 except that the outer form used to adjust the size and surface smoothness and remove folds was changed for an outer form whose inner surface was subjected to honing.

The spectral reflectance of the belt-like substrate obtained was 70%, its glossiness was 30, and the layer thickness of the colored layer, i.e., belt-like substrate was 80 μm.

The same meandering-preventive member and position detection member as in Example 1 were used.

1, and a full-color image print test was conducted in the same manner as in Example 1. As the result, the extent of color misregistration was as large as 400 μm, and images with a proper density were not formed with respect to both black and other colors.

The results of evaluation in the Examples and Comparative Examples are shown in Table 1. In the table, with regard to the evaluation of image density, it was ranked in the order of grade of.

A: Proper density.
B: Density with no problem.
C: Not proper density.

TABLE 1

| | Intermediate transfer belt width (mm) | Distance between meandering = preventive member and position detection member (mm) | Spectral reflectance of: belt-like substrate A (%) | Spectral reflectance of: position detection member B (%) | Difference bet. A & B | Layer thickness of colored layer (μm) | Belt-like substrate glossiness | Evaluation: Color mis-registration (μm) | Evaluation: Image density |
|---|---|---|---|---|---|---|---|---|---|
| Example: | | | | | | | | | |
| 1 | 242 | 223 | 70 | 8 | 62 | 80 | 70 | 20 | A |
| 2 | 260 | 240 | 68 | 8 | 60 | 80 | 40 | 30 | A |
| 3 | 242 | 222 | 62 | 10 | 52 | 100 | 64.2 | 40 | A |
| 4 | 242 | 222 | 52 | 8 | 44 | 30 | 67 | 45 | B |
| 5 | 242 | 223 | 70 | 67 | 3 | 80 | 70 | 70 | A |
| 6 | 242 | 223 | 70 | 80 | 10 | 80 | 70 | 70 | A |
| 7 | 242 | 223 | 74 | 8 | 66 | 250 | 70 | 90 | A |
| 8 | 242 | 223 | 72 | 8 | 64 | 150 | 70 | 70 | A |
| 9 | 242 | 223 | 15 | 8 | 7 | 80 | 50 | 70 | B |
| 10 | 242 | 223 | 65 | 8 | 57 | 80 | 30 | 70 | B |
| Comparative Example: | | | | | | | | | |
| 1 | 242 | End portion on the same side. | 70 | 8 | 62 | 80 | 70 | 200 | A |
| 2 | 242 | End portion on the same side. | 12 | 8 | 4 | 100 | 60 | — | — |
| 3 | 242 | End portion on the same side. | 20 | 8 | 12 | 30 | 66 | 300 | C |
| 4 | 242 | End portion on the same side. | 70 | 8 | 62 | 80 | 30 | 400 | C |

The meandering-preventive member was attached to one end portion of the belt-like substrate obtained by extrusion as described above, and in the peripheral direction of the inner periphery of the belt-like substrate at a position 3 mm shifted to the middle from the end.

On the outer periphery of the belt-like substrate at its end portion to which the meandering-preventive member was attached, the position detection seal was further stuck along the former's end, at four spots at equal intervals in the peripheral direction of the belt-like substrate, thus obtaining an intermediate transfer belt. The meandering-preventive member and the position detection seal (position detection member) were on the inside and outside at the same end portion, so that the distance between them in the width direction was 0 mm. The meandering-preventive member and the position detection member were both attached at the non-image formation region.

The intermediate transfer belt obtained was set in the electrophotographic apparatus constructed as shown in FIG.

According to the present invention, an electrophotographic endless belt can be provided which contributes to the formation of high-quality images having less color misregistration or image misregistration because of good meandering prevention and accurate position detection.

According to the present invention, an electrophotographic endless belt can also be provided which contributes to the formation of good images because of accurate and stable density detection.

According to the present invention, an intermediate transfer belt comprised of the above electrophotographic endless belt, and a process cartridge and an electrophotographic apparatus which have such an intermediate transfer belt, can also be provided.

What is claimed is:

1. An electrophotographic endless belt comprising:

a belt-like substrate;

a meandering-prevention member; and a position detection member, wherein said meandering-prevention member is disposed on the inner-periphery side of one end portion of said belt-like substrate, wherein said position detection member is disposed on the outer-periphery side of the other end portion of said belt-like substrate; and wherein said meandering-prevention member and said position detection member are kept apart by a distance of from 200 mm to 250 mm in the width direction of said electrophotographic endless belt, and wherein said meandering-prevention member and said position detection member are each disposed in a non-image formation region of said belt-like substrate.

2. The electrophotographic endless belt according to claim 1, wherein said meandering-prevention member and said position detection member are kept apart by a distance of from 220 mm to 250 mm in the width direction of said electrophotographic endless belt.

3. The electrophotographic endless belt according to claim 1, wherein the surface of said belt-like substrate has a spectral reflectance higher than that of the surface of said position detection member.

4. The electrophotographic endless belt according to claim 3, wherein the difference between the spectral reflectance of the surface of said belt-like substrate and the spectral reflectance of the surface of said position detection member is 5 or more.

5. The electrophotographic endless belt according to claim 1, wherein said belt-like substrate comprises a colored layer containing a colorant, and said colored layer has a layer thickness of from 40 $\mu$m to 200 $\mu$m.

6. The electrophotographic endless belt according to claim 5, wherein the colorant is a white pigment.

7. The electrophotographic endless belt according to claim 1, wherein said belt-like substrate has a glossiness of 35 or more.

8. The electrophotographic endless belt according to claim 1, wherein said electrophotographic endless belt is an intermediate transfer belt.

9. A process cartridge detachably mountable to a main body of an electrophotographic apparatus, said process cartridge comprising an intermediate transfer belt, said intermediate transfer belt comprising:

a belt-like substrate;

a meandering-prevention member; and a position detection member, wherein said meandering-prevention member is disposed on the inner-periphery side of one end portion of said belt-like substrate, wherein said position detection member is disposed on the outer-periphery side of the other end portion of said belt-like substrate; and wherein said meandering-prevention member and said position detection member are kept apart by a distance of from 200 mm to 250 mm in the width direction of said intermediate transfer belt, and wherein said meandering-prevention member and said position detection member are each disposed in a non-image formation region of said belt-like substrate.

10. The process cartridge according to claim 9, wherein said process cartridge at least integrally supports an electrophotographic photosensitive member for holding a toner image thereon and said intermediate transfer belt, said intermediate transfer belt being configured and positioned to form a contact zone between itself and the electrophotographic photosensitive member.

11. The process cartridge according to claim 9, wherein said meandering-prevention member and said position detection member arc kept apart by a distance of from 220 mm to 250 mm in the width direction of said intermediate transfer belt.

12. The process cartridge according to claim 9, wherein the surface of said belt-like substrate has a spectral reflectance higher than that of the surface of said position detection member.

13. The process cartridge according to claim 12, wherein the difference in the spectral reflectance of the surface of said belt-like substrate and the spectral reflectance of the surface of said position detection member is 5 or more.

14. The process cartridge according to claim 9, wherein said belt-like substrate comprises a colored layer containing a colorant, and said colored layer has a layer thickness of from 40 $\mu$m to 200 $\mu$m.

15. The process cartridge according to claim 14, wherein the colorant is a white pigment.

16. The process cartridge according to claim 9, wherein said belt-like substrate has a glossiness of 35 or more.

17. The process cartridge according to claim 9, further comprising at least one of a light-projecting part of a position detection sensor and a light-receiving part of the position detection sensor.

18. The process cartridge according to claim 17, wherein said position detection sensor is a reflection-type position detection sensor.

19. The process cartridge according to claim 9, further comprising a density detection sensor.

20. An electrophotographic apparatus comprising:

an electrophotographic photosensitive member configured and positioned to hold a toner image thereon;

charging means for charging said electrophotographic photosensitive member electrostatically;

exposure means for forming an electrostatic latent image on said electrophotographic photosensitive member having been charged by said charging means;

developing means for developing the electrostatic latent image formed on said electrophotographic photosensitive member by said exposure means, to form a toner image on said electrophotographic photosensitive member;

an intermediate transfer belt configured and positioned to form a contact zone between itself and said electrophotographic photosensitive member, and to secondarily transfer to a transfer material the toner image transferred after the toner image has been primarily transferred thereto from said electrophotographic photosensitive member; and primary transfer means for transferring the toner image primarily from said electrophotographic photosensitive member to said intermediate transfer belt at the contact zone therebetween, said intermediate transfer belt comprising:

a belt-like substrate;

a meandering-prevention member; and a position detection member, wherein said meandering-prevention member is disposed on the inner-periphery side of one end portion of said belt-like substrate, wherein said position detection member is disposed on the outer-periphery side of the other end portion of said belt-like substrate, wherein said meandering-prevention member and said position detection member are kept apart by a distance of from 200 mm to 250 mm in the width direction of said intermediate transfer belt, and wherein said meandering-prevention member and said position detection member are each disposed in a non-image formation region of said belt-like substrate.

21. The electrophotographic apparatus according to claim 20, further comprising a process cartridge in which at least said electrophotographic photosensitive member and said intermediate transfer belt are integrally supported and which is detachably mountable to a main body of said electrophotographic apparatus.

22. The electrophotographic apparatus according to claim 20, wherein said meandering-prevention member and said position detection member are kept apart by a distance of from 220 mm to 250 mm in the width direction of said intermediate transfer belt.

23. The electrophotographic apparatus according to claim 20, wherein the surface of said belt-like substrate has a spectral reflectance higher than that of the surface of said position detection member.

24. The electrophotographic apparatus according to claim 23 wherein the difference between the spectral reflectance of the surface of said belt-like substrate and the spectral reflectance of the surface of said position detection member is 5 or more.

25. The electrophotographic apparatus according to claim 20, wherein said belt-like substrate comprises a colored layer containing a colorant, and the colored layer has a layer thickness of from 40 $\mu$m to 200 $\mu$m.

26. The electrophotographic apparatus according to claim 25, wherein the colorant is a white pigment.

27. The electrophotographic apparatus according to claim 20, wherein said belt-like substrate has a glossiness of 35 or more.

28. The electrophotographic apparatus according to claim 20, further comprising a position detection sensor.

29. The electrophotographic apparatus according to claim 28, further comprising a process cartridge in which at least one of a light-projecting part of said position detection sensor and a light-receiving part of said position detection sensor, said intermediate transfer belt and said electrophotographic photosensitive member are integrally supported and which is detachably mountable to a main body of said electrophotographic apparatus.

30. The electrophotographic apparatus according to claim 28, wherein said position detection sensor is a reflection-type position detection sensor.

31. The electrophotographic apparatus according to claim 20, further comprising a density detection sensor.

32. The electrophotographic apparatus according to claim 31, further comprising a process cartridge in which said density detection sensor, said intermediate transfer belt and said electrophotographic photosensitive member are integrally supported and which is detachably mountable to a main body of said electrophotographic apparatus.

33. An electrophotographic endless belt comprising:

a belt-like substrate;

a meandering-prevention member; and a position detection member, wherein:

said meandering-prevention member is disposed on the inner-periphery side of one end portion of said belt-like substrate; and said position detection member is disposed on the outer-periphery side of the other end portion of said belt-like substrate.

34. A process cartridge detachably mountable to a main body of an electrophotographic apparatus, said process cartridge comprising:

an intermediate transfer belt comprising:

a belt-like substrate;

a meandering-prevention member; and a position detection member, wherein:

said meandering-prevention member is disposed on the inner-periphery side of one end portion of said belt-like substrate; and said position detection member is disposed on the outer-periphery side of the other end portion of said belt-like substrate.

35. An electrophotographic apparatus comprising:

an electrophotographic photosensitive member configured and positioned to hold a toner image thereon;

charging means for charging said electrophotographic photosensitive member electrostatically;

exposure means for forming an electrostatic latent image on said electrophotographic photosensitive member having been charged by said charging means;

developing means for developing the electrostatic latent image formed on said electrophotographic photosensitive member by said exposure means, to form a toner image on said electrophotographic photosensitive member;

an intermediate transfer belt which is configured and positioned to form a contact zone between itself and said electrophotographic photosensitive member, and to secondarily transfer to a transfer material the toner image transferred thereto from said electrophotographic photosensitive member; and primary transfer means for transferring the toner image primarily from said electrophotographic photosensitive member to said intermediate transfer belt at the contact zone therebetween, said intermediate transfer belt comprising:

a belt-like substrate;

a meandering-prevention member; and a position detection member; wherein:

said meandering-prevention member is disposed on the inner-periphery side of one end portion of said belt-like substrate; and said position detection member is disposed on the outer-periphery side of the other end portion of said belt-like substrate.

36. An electrophotographic endless belt comprising:

a meandering-prevention portion; and a position detection portion, wherein:

said meandering-prevention portion is at the inner-periphery side of one end portion of said electrophotographic endless belt; and said position detection portion is at the outer-periphery side of the other end portion of said electrophotographic endless belt.

37. A process cartridge detachably mountable to a main body of an electrophotographic apparatus comprising:

an intermediate transfer belt, said intermediate transfer belt comprising:

a meandering-prevention portion; and a position detection portion; wherein:

said meandering-preventive portion is at the inner-periphery side of one end portion of said intermediate transfer belt; and said position detection portion is at the outer-periphery side of the other end portion of said intermediate transfer belt.

38. An electrophotographic apparatus comprising:

an electrophotographic photosensitive member configured and positioned to hold a toner image thereon;

charging means for charging said electrophotographic photosensitive member electrostatically;

exposure means for forming an electrostatic latent image on said electrophotographic photosensitive member having been charged by said charging means;

developing means for developing the electrostatic latent image formed on said electrophotographic photosensitive member by said exposure means, to form a toner image on said electrophotographic photosensitive member; and an intermediate transfer belt which is configured and positioned to form a contact zone between itself and said electrophotographic photosensitive member, and to secondarily transfer to a transfer material the toner image transferred after the toner image has been primarily transferred thereto from said electrophotographic photosensitive member; and primary transfer means for transferring the toner image primarily from said electrophotographic photosensitive member to said intermediate transfer belt at the contact zone therebetween, said intermediate transfer belt comprising:

a meandering-prevention portion; and a position detection portion, wherein:

said meandering-prevention portion is at the inner-periphery side of one end portion of said intermediate endless belt; and said position detection portion is at the outer-periphery side of the other end portion of said intermediate endless belt.

* * * * *

UNITED STATES PATENT AND TRADEMARK OFFICE

CERTIFICATE OF CORRECTION

PATENT NO. : 6,856,776 B2
DATED : February 15, 2005
INVENTOR(S) : Hidekazu Matsuda et al.

It is certified that error appears in the above-identified patent and that said Letters Patent is hereby corrected as shown below:

Title page,
Item [75], Inventors, "Akihiko Nakazwa" should read -- Akihiko Nakazawa --.

Column 1,
Line 45, "ever" should be deleted.

Column 3,
Line 14, "a high" should read -- high a --.
Line 37, "can not" should read -- cannot --.

Column 7,
Line 36, "can not" should read -- cannot --.

Column 18,
Line 1, "an" should read -- and --.
Line 19, "4 min." should read -- 4 mm. --.

Column 23,
Line 63, "respect" should read -- respect to --.

Column 31,
Line 17, "23" should read -- 23, --.

Signed and Sealed this

Twenty-seventh Day of September, 2005

JON W. DUDAS
*Director of the United States Patent and Trademark Office*